US011786804B2

(12) United States Patent
Peterson

(10) Patent No.: US 11,786,804 B2
(45) Date of Patent: Oct. 17, 2023

(54) THERAPEUTIC CUSTOMIZABLE GAME BOARD SYSTEM

(71) Applicant: Joel T. Peterson, Blairstown, NJ (US)

(72) Inventor: Joel T. Peterson, Blairstown, NJ (US)

( * ) Notice: Subject to any disclaimer, the term of this patent is extended or adjusted under 35 U.S.C. 154(b) by 62 days.

(21) Appl. No.: 17/224,875

(22) Filed: Apr. 7, 2021

(65) Prior Publication Data

US 2021/0316207 A1 Oct. 14, 2021

Related U.S. Application Data

(60) Provisional application No. 63/009,763, filed on Apr. 14, 2020.

(51) Int. Cl.

| | |
|---|---|
| ***A63F 3/00*** | (2006.01) |
| ***A63F 1/04*** | (2006.01) |
| ***A63F 3/04*** | (2006.01) |

(52) U.S. Cl.

CPC ..... *A63F 3/00261* (2013.01); *A63F 1/04* (2013.01); *A63F 3/0023* (2013.01); *A63F 3/00694* (2013.01); *A63F 3/0478* (2013.01); *A63F 2001/0441* (2013.01); *A63F 2001/0475* (2013.01); *A63F 2003/00239* (2013.01); *A63F 2003/00391* (2013.01); *A63F 2003/0489* (2013.01)

(58) Field of Classification Search

CPC ..... A63F 3/00261; A63F 1/04; A63F 3/0023; A63F 3/00694; A63F 3/0478; A63F 2001/0441; A63F 2001/0475; A63F 2003/00239; A63F 2003/00391; A63F 2003/0489; A63F 3/00006; A63F 3/00075; A63F 3/00148; A63F 2001/027; A63F 2003/00066; A63F 2003/00233; A63F 2003/0439; A63F 2009/0007; A63F 2011/0018; A63F 2011/0072

See application file for complete search history.

(56) References Cited

U.S. PATENT DOCUMENTS

| | | | | |
|---|---|---|---|---|
| 3,399,893 | A * | 9/1968 | Payne, Jr. | A63F 3/00041 116/223 |
| 3,801,104 | A * | 4/1974 | Potts | A63F 3/0457 273/287 |
| 3,860,242 | A * | 1/1975 | Martin | A63F 3/00 273/284 |
| 5,435,565 | A | 7/1995 | Benaderet | |
| 6,203,017 | B1 * | 3/2001 | Schultz | A63F 3/0023 273/287 |
| 6,659,774 | B1 | 12/2003 | Ramos et al. | |
| 6,685,187 | B1 | 2/2004 | Kline | |

(Continued)

*Primary Examiner* — Michael D Dennis

(74) *Attorney, Agent, or Firm* — Jack Baldini, Esq.

(57) ABSTRACT

A customizable board game to operationalize various therapeutic modalities as a means to explore, learn, engage, and provide emotional and relational support in a non-traditional therapy environment. Through engagement in play activities, individuals learn about cause and effect; practice categorizing and organizing information; develop comprehensive storylines and understanding surrounding personal experiences; and can explore traditional and non-traditional roles, such as gender, family, friends, academic, etc., in a non-confrontational, fun, and no stress environment to free up emotions and other typical barriers to self reflection.

5 Claims, 21 Drawing Sheets

(56) References Cited

U.S. PATENT DOCUMENTS

| | | | | |
|---|---|---|---|---|
| 8,827,270 | B1 * | 9/2014 | Fiore | A63F 3/00697 273/287 |
| 2006/0255539 | A1 * | 11/2006 | Webber | A63F 3/00694 273/239 |
| 2013/0087973 | A1 | 4/2013 | Bettner | |
| 2019/0304329 | A1 | 10/2019 | Webb | |

* cited by examiner

THERAPEUTIC CUSTOMIZABLE GAME BOARD SYSTEM

This application claims priority to Provisional U.S. Patent Application Ser. No. 63/009,763, filed Apr. 14, 2020, which is incorporated herein as if fully set forth.

FIELD OF THE INVENTION

A customizable board game to operationalize various therapeutic modalities as a means to explore, learn, engage, and provide emotional and relational support in a non-traditional therapy environment. Through engagement in play activities, individuals learn about cause and effect; practice categorizing and organizing information; develop comprehensive storylines and understanding surrounding personal experiences; and can explore traditional and non-traditional roles, such as gender, family, friends, academic, etc., in a non-confrontational, fun, and no stress environment to free up emotions and other typical barriers to self reflection.

BACKGROUND

The use of games in general to facilitate diagnosis, teaching, learning, and other cognitive development is not new. Even games thought to be purely "for fun" can be very educational, teaching about probability and statistics, the value of money, investment, vocabulary and language, and the like, as well as being inspirational and uplifting. Moreover, the use of games for purely educational purposes is known in the prior art. Very few games are so intuitive that no learning is required to play and even intuitive games may have arbitrary rules.

Most, if not all, known games, have a particular purpose or set of rules and either an end goal (generally, to win), or an overarching purpose and method of play to attain the goal or purpose without much ability to customize anything. One notable exception is the fantasy tabletop role playing game under the name Dungeons and Dragons®, which is described as being derived from wargames and commonly recognized as the beginning of modem role-playing games. Dungeons & Dragons® is also described as a structured yet open-ended role playing game involving a variety of social and other useful cognitive skills, such as logic, basic mathematics and imagination. Despite the flexibility, game mechanics and die rolls still determine much of what happens.

There have been many prior iterations of board games, card games, chance games, role-playing games, and the like, made for pure fun and enjoyment, as well as to develop cognitive skills and for therapeutic reasons.

For example, U.S. Pat. No. 5,435,565, BOARD GAME RELATING TO STRESS, by David M. Benaderet, discloses, "a board game relating to stress comprising a plurality of game pieces each representing a player; at least one die; a plurality of stacks of situation cards with the stacks representing categories of stressful situations, cheerful situations, and combinations thereof and with each situation card describing an action required of a player; a plurality of certificates with each certificate representing a number of years of a player's life with certificates being accumulated and forfeited based on situations encountered; a stack of anti-stress cards with each card representing a way of avoiding a loss of certificates when encountering stressful situations requiring the forfeiture thereof; and a game board having a starting space thereon representing the initiation of a journey through life, an ending space thereon representing the completion of the journey, and a plurality of situation spaces therebetween representing stressful categories, cheerful categories, and combinations thereof with each category represented on the board keyed to a corresponding stack of situation cards of the same category."

In another example, U.S. Pat. No. 6,659,774, DIAGNOSTIC GAME AND TEACHING TOOL, by Tri-Sil LLC, discloses, "a plurality of large, tactically soft, cubes, and a plurality, of learning game boards. Each side of a learning cube has imprinted thereon a teaching concept. Each learning game board has a teaching concept imprinted thereon corresponding to a learning cube."

In another example, U.S. Pat. No. 6,685,187, THERAPEUTIC ROLE-PLAYING BOARD GAME, by Beverly Kline, discloses, "a game apparatus and method for playing a game is disclosed. The game includes a board and a first set of cards bearing indicia of a situation to be enacted by the players and a second set of cards bearing indicia of at least one of a role, style or feeling for the situation to be enacted by the players. The game includes moving a player piece along a path of movement on the game board."

In another example, U.S. Patent Application Publication No. US 2013/0087973 A1, INTERACTIVE SCENARIO GAME AND TEACHING TOOL, by Mark Bettner, discloses, "an educational tool that teaches self-control and anger management skills during an argument. The game comprises at least two players, at least one deck of cards and a lip cover for each player involved in the game. A card is drawn between two players, wherein the card includes a scenario in which a confrontation may ensue or one that may draw an emotional response during discussion. The two players act out the scenario and discuss a resolution, while all other players monitor the discussion. If one of the other players believes the conversation is becoming too emotional or out of control, that player may initiate the lip covers for all players, allowing time for each player to think without speaking to regain self-control. This game may be used as a confrontation or human resources teaching tool, or a therapy tool for families to discuss topics while learning self-control."

In another example, U.S. Patent Application Publication Number US 2019/0304329 A1, TOOL FOR REHABILITATING LANGUAGE SKILLS, by Ayana Webb, discloses, "an educational tool that teaches self-control and anger management skills during an argument. The game comprises at least two players, at least one deck of cards and a lip cover for each player involved in the game. A card is drawn between two players, wherein the card includes a scenario in which a confrontation may ensue or one that may draw an emotional response during discussion. The two players act out the scenario and discuss a resolution, while all other players monitor the discussion. If one of the other players believes the conversation is becoming too emotional or out of control, that player may initiate the lip covers for all players, allowing time for each player to think without speaking to regain self-control. This game may be used as a confrontation or human resources teaching tool, or a therapy tool for families to discuss topics while learning self-control."

What remains missing therefore, is a fully customizable, game vehicle, capable of integrating any number of therapeutic modalities, targeting the specific theme of interest to an individual, capitalizing on the natural proclivity for learning through play, while not being tied to any one or more specific manner of play methods. In certain situations, moving a player token along a board path may produce desirable outcomes, whereas in a different situation, merely engaging with game prompts without any 'ladder' type of player piece movement to 'track' winning at a given stage may be more desirable.

Disclosed herein is a fully customizable game vehicle that enables a therapeutic engagement to be informed by individual needs surrounding attachment, assessment and intervention. Positive cognitive development and therapeutic processes and content can be introduced and implemented through the lens of any therapeutic modality, such as Cognitive Behavioral Therapy, Dialectical Behavioral therapy, and Role Therapy, as non-limiting examples.

The process of building and customizing the game can be as valuable as playing the game once set up and elicits continuous kinesthetic experiential for skill building (i.e., decision-making processes, thought processes, strategy building processes, and the like, through concrete activities such as peripheral prompts and the building of the game board itself). The building and ultimately playing of the game described herein is called the Templay Engagement Process and combines procedural tasks with imaginative prompts to elicit a free association response and self-reflective and educational interactions and processes within the structured framework.

Thus, all of the disclosed references provide games with defined limits and sets of rules that do not allow for the fully customizable and limitless imaginative variation and complexity as will be described in the Templay Engagement Process.

The present disclosure goes beyond any of the known prior art, expanding problem solving strategies, offering a custom process development component, to accomplish a robust interpersonal game tool. The prior art games have inherent limitations due to previously developed content and the many assumptions made in the application of such prompts including but not limited to the types of content that would be engaging to a participant, what specific subject matter is most suited to the unique individual and the purposes of the engagement, etc. These assumptions include the Reflection Content (i.e. question prompts, paper activities, etc.) and Game Structure (rules, type of interpersonal experiences elicited, activities included, etc.) as well as the thematic content (i.e. overall theme and images). Generally speaking, it is the thematic content which makes traditional board games unique and enticing, while the Reflection Content and Game Structure are what keep the individuals engaged as players. The game structure, specifically in terms of supportive interactions, significantly impacts the quality of the individual's engagement and investment in the game prompt, as well as the types of interpersonal experiences elicited during the engagement.

SUMMARY

In general, the Templay Engagement Process provides a robust, customizable game environment comprising a customizable game board, game markers, game decisional means and incorporating concrete tasks and activities allowing an engager to continuously reinforce, introduce, and/or associate professional content (i.e., theoretical concepts, factual information such as the physiological process of emotions, etc.) and personal content (i.e., personal experiences, relationships, emotions, etc.) through tangible tasks at hand, thereby providing kinesthetic, auditory and visual educational and supportive experiences.

One skilled in the art will appreciate the full customizability and adaptability of the Templay Engagement Process game to various target experiential and desired goals and means to achieve those results.

The Templay Engagement Process game board and play is unique as it allows the engager to integrate the interests and proclivities (i.e. being more responsive to kinesthetic activities as opposed to paper prompts or direct conversation, etc.) of the individual being engaged and to personalize the reflection content to include information particularly relevant to the unique purposes of that supportive interaction. The Templay Engagement Process game is the only engagement prompt board game that allows any theme or subject matter to be concretely integrated into a single "game board" type prompt resource. For example, one of the components of the Templay Content Kit is the "Situational" Question Card which allows the engager to phrase a target question in a way that includes components of the individuals' specific life experience within the question text. The card prompts the engager to elicit the specific information, as needed, to pose the question (i.e. Youth's favorite toy, Someone the youth loves, etc.) and then integrates the elicited information into the question card (i.e. "If a classmate broke (Youth's Favorite Toy), what is something (Someone the Youth Loves) could do to help?".) Character Cards are similar to Situational Cards but include questions using a themed character as one of the focuses of the question to offer distance between the youth and question. An example would include "What do you think (Youth's Favorite Superhero) does when he/she is (Emotion)?". Another means of personalizing Templay Reflection content includes a digital platform which offers templates to edit and print customizable Question Cards, Concept Cards, Content Markers and Reflection Cards. This allows engagers to directly integrate the "personalized" subject matter as fixed Reflection Content. This is an integral component to the Templay Board as it reduces the need for the engager (counselor, teacher, caregiver, etc.) to direct the discussion to the specific subject matter and instead include it as a fixed part of the game prompt. For example, consider a youth receiving support after losing a parent through death who also reportedly lost a family pet two years prior. The engager would be able to integrate questions such as "Have you ever had a pet that you don't have right now? Where are they now?" and/or "What was it like to lose your pet?" as Templay Question Cards.

Engaging an individual in emotionally provocative and/or uncomfortable subject matter may be made less "intimidating" for the engager and/or the youth when posed as a part of the game structure as compared to a direct question and/or statement. This may be viewed as being similar to "distancing" and is a fundamental component of Play Therapy which can be seen in engagements such as "Puppet Play" or "House, Tree, Person". Additionally, the Templay Board Content Inserts allow the engager to insert images depicting themes that are of particular interest to that specific individual (i.e. youth, etc.) which allows the board game to be built around any theme of interest to the individual (i.e. Baseball, Outer Space, etc.).

In contrast to other game board related prior art, the Templay Board also capitalizes on the game development (i.e. creation, etc.) process. Game development may be as beneficial as the subject matter and/or "interventions" in terms of rapport building, assessment of decision-making processes and myriad other relevant factors. This structured, kinesthetic engagement style is a core component of Play Therapy and can be seen in engagements such as Jungian Sand Play Therapy. The Templay Board allows the engager and the individual (client, student, etc.) to participate in placing the spaces in a format of their design, thereby "building" the board game prompt as a part of the engagement experience. The surface of the Templay Board may be magnetic and the Templay Spaces would then be magnetic strips that are placed onto the board in the desired fashion, as opposed to being fixed (i.e. printed directly on the board). Additionally, magnetic Structure Inserts, which allow for images and content to be directly associated with a space on the board, offer additional options for the Game Structure. Examples of Structure Inserts includes but is not limited to ponds, bridges, "Take an Extra Turn" spaces, space portals, etc.

In one embodiment, the Templay Engagement Process game comprises:

a Templay Board that is fully customizable as an engagement prompt for the purposes of offering a structured supportive interaction through the context of a board game wherein board structure components are chosen from the group of:

spaces, fully arrangeable as desired on the board;

content inserts, which may be any one or more of: spinner inserts, prompt inserts, engagement inserts, structure inserts, and theme inserts; and miscellaneous inserts, which may be any one or more of: markers, other game components, cards, sports inserts, and outside activity inserts;

Templay Cards used in game play comprising cards chosen from the group of:

Question Cards; Character Cards; Situational Cards; Concept Cards; Emotion Cards; Reflection Cards; and Peripheral Prompt Cards;

Content Markers;

Game Pieces;

Game Currency;

Game Decisional Means, chosen from the group of:

Dice (with numbers, colors, and three or more sides); Random Number Generator; Spinner; and Coin;

Optional components comprising, outside pre-existing trading cards, pictures, artwork, pre-existing short-term games, and any creative and/or educational activity.

In one embodiment, the Templay Board is magnetic and white to allow for easy manipulation and overlay of spaces and inserts. In an alternative embodiment, any fastening mechanism could be used, such as for example, hook and loop fastener. In an alternative embodiment, no attachment means is necessary, the board and elements being simply loosely placed.

In one embodiment, the spaces are also magnetic to allow for easy manipulation and arrangement on the surface of the Templay Board. In an alternative embodiment, any fastening mechanism could be used, such as for example, hook and loop fastener. In an alternative embodiment, no attachment means is necessary, the board and elements being simply loosely placed.

In one embodiment, the spinner is a fixed, flat structure which has a removable clear, plastic cover, four spaces to place Content Inserts, (i.e. prompt and theme images) and a spinner.

In one embodiment, the Templay Board is configured to include two spinners. Each spinner is intended to be used in three primary contexts, however may be adapted as a part of the Templay Engagement Process. The three primary Templay Spinner Structures are as follows:

Content Spinner—Support content (emotions, grief, relationships, etc.) is integrated into the spinner content. For example, if using drama-related engagements, the categories of interpersonal, emotional, situational and cognitive dimensions of the self can be depicted, requiring the participant to act out whatever dimension of self-experience the spinner lands on. Inserts can be customized as appropriate;

Engagement Spinner—Determines which Reflection Content or Peripheral Prompt (i.e. Table-top Hockey, Scavenger Hunt, Puzzle, etc.) is engaged in. Inserts can be customized as desired;

Winner Spinner—Determines the manner in which the "winner" of the game is decided. The Winner Spinner is not used until the end of the engagement. This serves to dilute any focus on the idea of "winning" the game and allow the primary focus to be on the engagement itself. Inserts can be customized as desired. Standard examples of game outcomes include but are not limited to the following:

Number of Tokens (most or least)

Number of Cards (most or least)

Board Placement (first, second, third, last, etc.)

Roll of the Dice (highest or lowest number).

In one embodiment, content may comprise emotions, family, grief, self-awareness, and the like. In this embodiment, Reflection Cards are fixed print resources which offer three columns and four rows of expressive images such as paintings, pictures and specific characters such as emojis, types of animals, etc., as an engagement prompt. These are used as a framework of reference and/or expressive activity throughout the supportive interaction. Each card includes images that the participant may identify as representing specific components of the support content (i.e. emotions, etc.) based upon their subjective interpretation of the images. The engager is encouraged to fully explore the participant's identification and/or projection of their experiences/substance on the image.

In one embodiment, Concept Cards are content prompts which allow the interaction to elicit opportunities to conceptualize engagement content; organize content into taxonomical categories; and compare and contrast ideas. This component of engagement is central to comprehension and understanding. The concepts portrayed on the card may be themes, groups, types, etc. relevant to the support content (i.e. physical feelings and emotional feelings, grief triggers and daily stressors, etc.) Content Markers may be physically placed next to the appropriate Concept Card as the identifying activity and/or be verbally associated as part of the engagement.

In one embodiment, Content Markers are individual content prompts which depict a specific concept or construct. The content may include professional and/or individual content material depending upon the purpose of the supportive interaction. Content Markers may be used to determine the specific concept or construct (i.e. anger, sadness, etc.) to be explored in an activity (i.e. marking Reflection Cards, body tracing, etc.).

In one embodiment, Question Cards are 2⅜×3⅜, or other similarly sized, easily utilized, card prompts which offer questions to promote self-reflection and self-expression of personal and professional content. Engagers are encouraged to develop their own content and questions and integrate it into the included Templay Content Kits. The three distinct categories of Templay Question Cards are as follows: Traditional Question Cards, Situational Content Cards, and Character Question Cards.

In one embodiment, there are myriad ways in which the Templay Board may be used in terms of game structure. Suggestions and examples of structures would be included, but engagers are encouraged to modify and develop the engagement structure based upon their assessment of the participant and the context and purpose of the interaction and or subjective interest. These structures can be used with any gameboard, manufactured or "homemade", with some effort, guidance and creativity.

In one embodiment, the game is played in standard fashion, the Traditional game play, wherein players take turns rolling the dice, or use other chance mechanism as determined in game set-up, and engage in the resulting activity (i.e. Question Cards, Reflection Cards, Peripheral Prompt, etc.). One token is offered per activity and/or question. The Templay Spinner may be used in the "engagement" capacity, meaning that it would determine different activities (Question Cards, Reflection Cards, Peripheral Prompt, etc.). Colored spaces on the board may also be used to determine the engagement activities (i.e. yellow for paper activity, white for question cards, blue for peripheral activity, etc.).

In an alternative embodiment, the game is played in a discretional mode, the Discretional game play, wherein players take turns rolling the dice and engaging in the resulting activity. Either the engager and/or the other player(s) "score" responses and engagements and offer tokens accordingly. The Templay Spinner may be used in the "engagement" capacity, meaning that it would determine different activities (Question Cards, Reflection cards, Peripheral Prompt, etc.). Colored spaces on the board may also be used to determine the engagement activity (i.e. yellow for paper activity, white for question cards, blue for peripheral activity, etc.). Additionally, the engager may purposefully select which activity will be utilized, as opposed to utilizing a Templay Spinner, to introduce a specific concept, concept, prompt, etc. For example, the engager may determine it would be more beneficial to engage with the concept of anger through the completion of an emotional body tracing as opposed to marking the Reflection Content Card, as doing so may offer a more useful outcome.

In another embodiment, the game may be played with other integrated components such as card games. Cards would be incorporated into the game structure at game set-up and interpersonal engagement as peripheral and/or content prompts. In this embodiment, players collect cards to acquire a full "hand", (i.e. deck, etc.) and then engage in the card game according to the specific structure of the card game. As appropriate, the Content Value of the cards may be discussed as they are acquired by each player. Content Value may be introduced through questions and/or reflection statements. Tokens may be exchanged and/or awarded to the "winner" of the "hand", "match", etc.

In other embodiments, other types of cards may be utilized, such as sports cards or themed cards. Play is similarly structured.

In one embodiment, a winner is determined traditionally, i.e., the player with the most tokens, cards, currency, points, etc. In alternative embodiments, a winner could be determined by use of a winner spinner, or through a purposeful approach wherein the engager controls outcome to allow the participant to win in order to promote esteem or maintain a tie or have the participant lose to promote the opportunity for nurturing, coping, etc.

In one embodiment, game play is as follows: Players can only move in one direction (i.e. clockwise or counterclockwise) per turn. A sense of urgency can be added to the game structure by allowing the players to count spaces but put a time limit on the decision by use of an outside timing device (i.e., an egg timer, stop watch etc.). Each player gains one Currency (i.e. token, gem etc.) each turn, as applicable. Players can pick up the card associated with the space they land on to add to their Card Bank. If a player lands on the corner space, they can either take the card associated with the spaces or select a Choice Card. Players can utilize a Structure Content Marker at any point during their turn. Players can exchange three currency for a Choice Card or to spin the Theme Spinner (as applicable) at any point during their turn. Players can exchange five cards from their Card Bank for a Choice Card.

In alternate embodiments, rules may include such game actions as players taking an extra turn, players taking cards from another player, player taking a card from any space on the board, etc.

In one embodiment, the Templay Board can incorporate structure inserts. For example, a Content Marker insert means when a player lands on this space, they will draw a Templay Card. Alternatively, a currency insert means that when a player lands on a space with this insert, they obtain one currency.

In one embodiment, the Templay Board serves as a malleable "prototype" for Board Game development, "Do It Yourself-ers" and other game enthusiasts. Templay Content Singles, (Templay Theme Packages; alternate Templay Spaces designs and Structure Inserts; etc.) are made available to offer a wide variety of potential Customized Board Games. The Content Inserts also allow for the engager to utilize external (i.e. personally developed, contracted etc.) theme content. Engagers are able to use the Templay Reflection Content Templates to develop their own Reflection Content (i.e. question cards, markers, etc.) or to integrate external content.

In one embodiment, the Templay Board can be arranged and utilized in a chess or checkers format, or in a bingo format, or in a four-in-a-row format, or in almost any pre-existing game format at all.

In one embodiment, an experiential is an activity that purposefully elicits an observation, experience of a specific process (i.e., emotional, cognitive, etc.), and/or introduces a specific concept or construct wherein the engagement activity takes place within a larger interaction that includes the relational dynamics and dialogue between the engager and the participant(s).

In one embodiment, a peripheral prompt is an activity that specifically serves to keep youth engaged throughout the supportive interaction and are not directly connected to the substance of supportive content and may include things like mini-golf, darts, paper activities (i.e., drawings, word searches, etc.), ring toss, or any other external and relatively short engagement activity.

In one embodiment, a content prompt is a prompt that illustrates a specific concept, idea, and the like, such as using a series of images to identify emotions.

In one embodiment, content value equates with thematic characteristics of a prompt (image, character, activity, etc.) that are used as a metaphor for support content. For example, Wolverine's (the superhero) healing powers can be viewed as being a defensive mechanism that allows him to put himself in harm's way and still be able to recuperate. He's isolative, "rough around the edges" and keeps people at a distance but is simultaneously loyal, caring and self-sacrificing. Other concepts include Integration defined as the act of combining separate, unique components into a collective, harmonious whole; and a reflection statement which are purposeful comments offered by the engager meant to introduce content, elicit an experience (cognitive, emotional, etc.) and/or direct the supportive interaction.

In one embodiment, the foregoing reference to structure inserts, spinners, and content markers, these may simply be adaptable housings rather than fixed images on a surface, housing images inserted therein according to the construct of a particular game set-up engagement process. In an alternative embodiment, the structure inserts, spinners, and content markers do contain specific fixed images for use in conjunction with particular game process embodiments.

In one embodiment, all of the foregoing as physically manifested may also be digitally reproduced and appear virtually on a video monitor or graphic screen.

BRIEF DESCRIPTION OF THE DRAWINGS

The accompanying drawings, which are incorporated herein and form part of the specification, illustrate various embodiments of the customizability of the game board, development of the game play and rules, and various opportunities for interactive process engagement.

DETAILED DESCRIPTION

Figure 1:
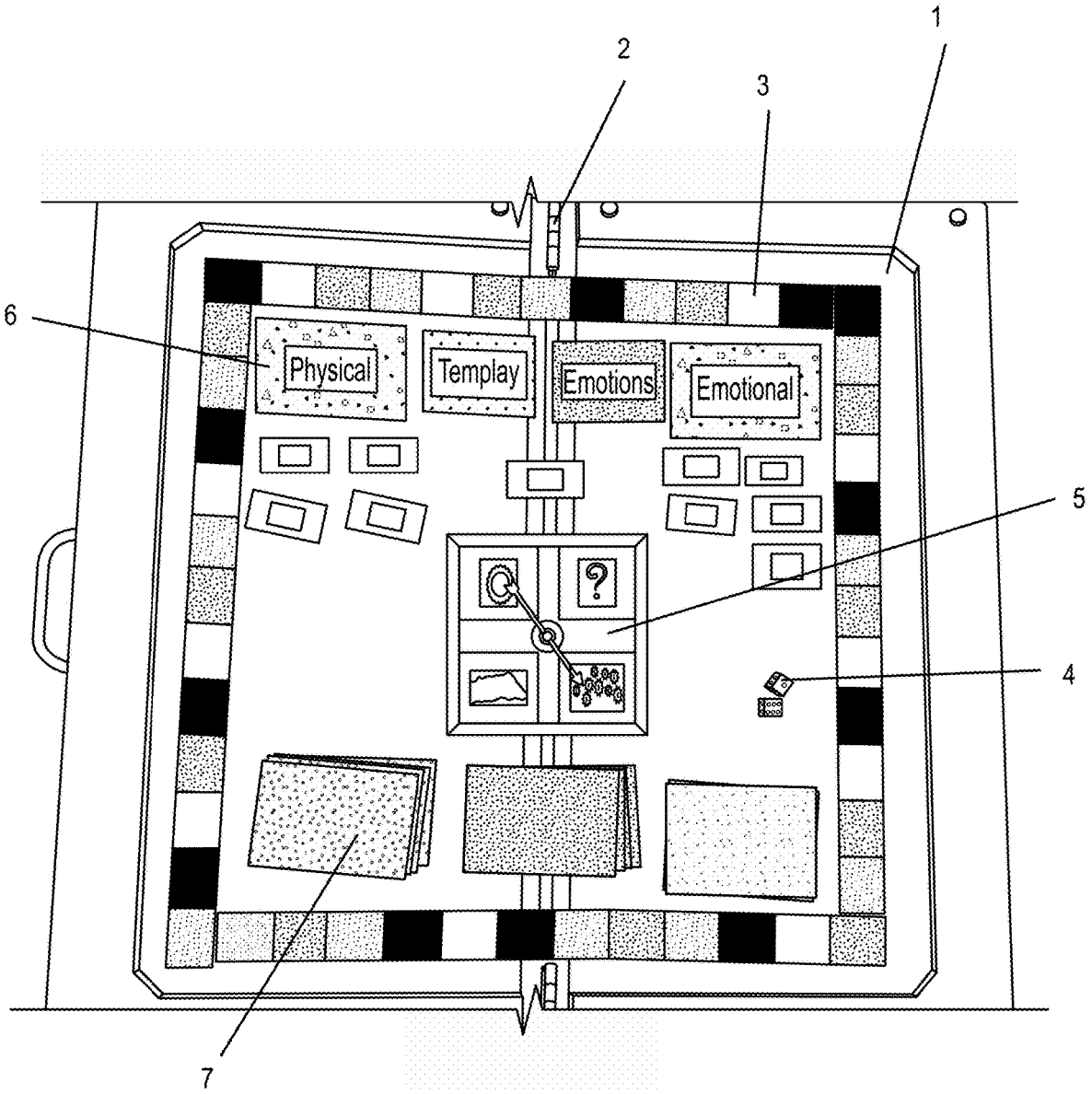
FIG. 1 depicts one embodiment of a Templay Engagement Process game board from an overhead view developed with traditional spaces for players to land on various board spots via moving a game piece according to a roll of dice or a spin of a spinner and landing on a certain space prompts a resulting activity, such as a question card, a reflection card, a peripheral prompt, and the like. In this embodiment, the game board spaces may be of differing colors that may also be used to determine engagement activities.

For clarity of disclosure, and not by way of limitation, the detailed description of the invention is divided into the following subsections that describe or illustrate certain features, embodiments or applications of the present invention.

It will be appreciated by one skilled in the art that the examples and features described herein are not mutually exclusive unless specifically so stated and that many combinations of game play can be obtained by following the guidance of this disclosure.

In one embodiment, an engager, who could be a counselor, teacher, caregiver, parent, and the like, would actively reflect on the specific purpose of the proposed engagement with a proposed individual participant. The context of the engagement, the end purpose—for example, music education, grief counseling, inner reflection and growth, and the like—will inform each aspect of the engagement process. A different context may call for a different approach to the structure or process to be implemented. For example, a student-teacher engagement may look quite different from a player-coach engagement. While in both situations, there is an authority hierarchy and expectation of following direction, the player-coach relationship may dictate a more authoritarian and team—oriented mentality as opposed to a nurturing and single-minded approach in a pure educational environment. A therapist-patient situation may dictate an even more nurturing and less rigid approach. Depending on the goal, the approach may vary along a multi-faceted scale whose components comprise the degree of authoritarianism, allowance for creativity, developing winning strategy versus contributing to the collective whole, accomplishing versus participating, adherence to a set structure versus allowing an individual path to be followed, and the like.

In one embodiment, the engager reflects on the subject matter to be introduced and the best methodologies for its introduction and development. This will lead to inclusion of desired activities, processes and sequences of play and interpersonal interactions. For example, the engager will determine whether emotional reflection or emotional expression is a desired outcome. This will lead to the development of areas of focus (i.e., emotional dysregulation surrounding disappointment and frustration, etc.) and/or a storyline or narrative, if applicable, that could validate and encourage exploration of experience, roles, etc., through the introduction of play activities and associating those play activities with the participant's personal desires and needs. The engager can validate, normalize and encourage a participant based on winning the game, or merely winning certain activities or processes within the game and the game may never even finish.

In one embodiment, once the foregoing goals and attributes have been considered, the engager then determines the structure—this being the heart of the Templay Engagement Process of building the game—a path and space oriented game, a playing field type game, a role-playing more creative approach, and the like, as demonstrated in the Figures. The game structure is defined as the physical layout of the board, i.e., spaces, obstacles, cards used, dice or spinner used, markers, currency, and the like. The rules for this embodiment are developed in conjunction with the structure.

Figure 2:
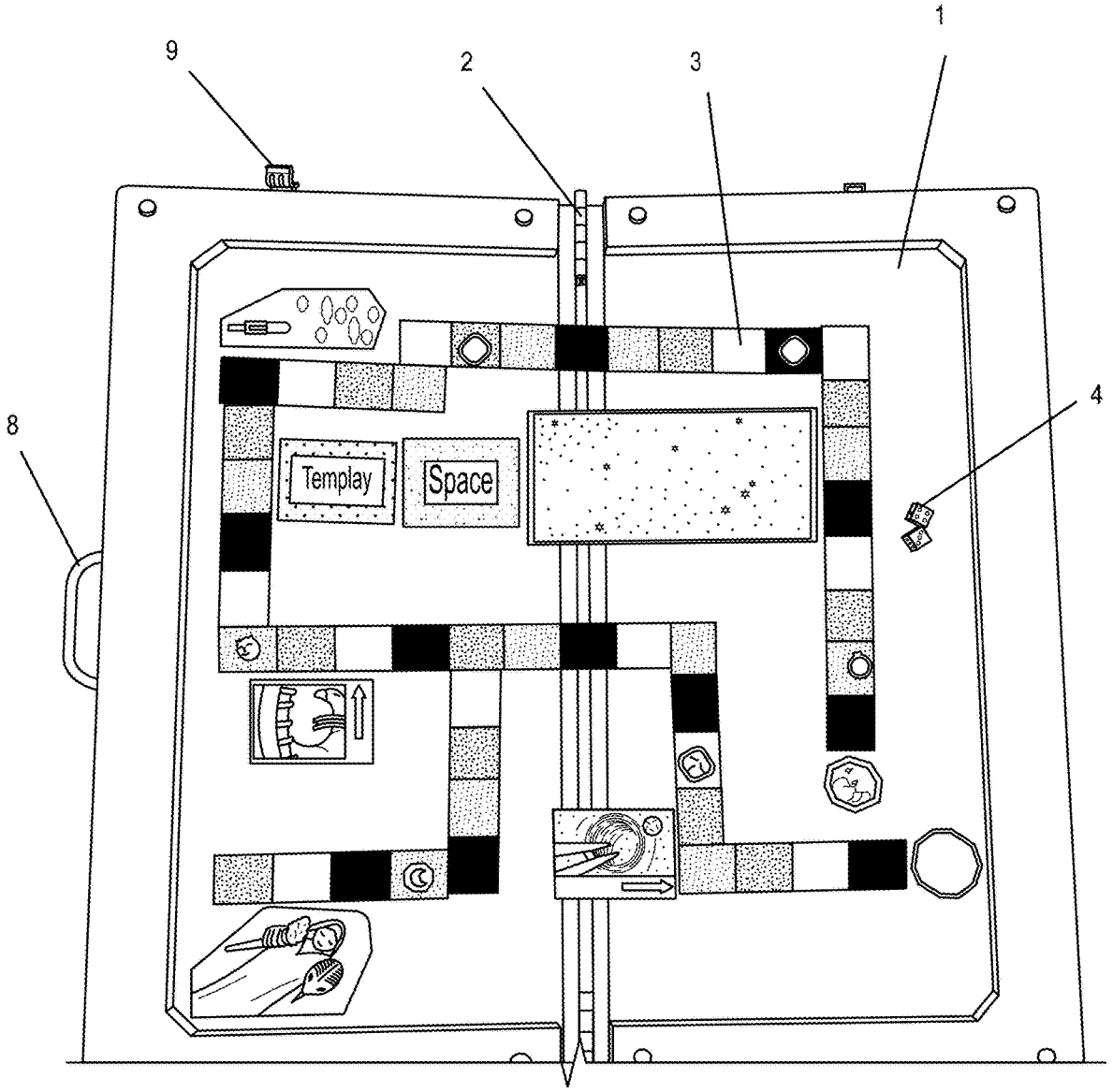
FIG. 2 depicts one embodiment of a Templay Engagement Process game board from an overhead view developed with traditional spaces, but in a non-traditional path course, and integrating other pictorial components that may be utilized in how a player can land on certain spaces or for what happens when the player lands on a certain space, all according to how the board is cooperatively developed.
Figure 3:
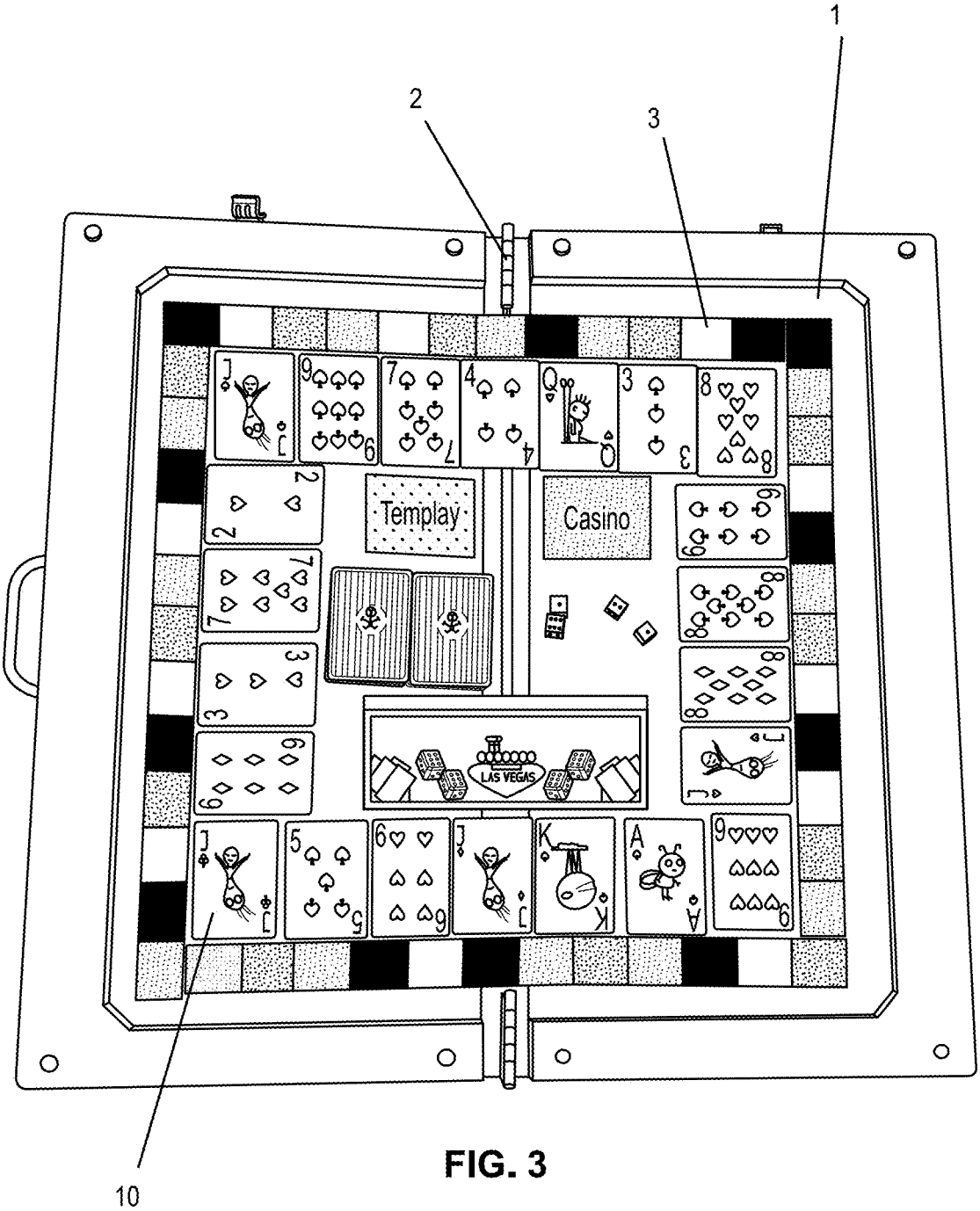
FIG. 3 depicts one embodiment of a Templay Engagement Process game board from an overhead view developed with traditional spaces, but integrating the use of standard deck of cards wherein a player could "collect" cards to acquire a full hand according to any number of traditional card games (a poker hand, a gin rummy hand, for example), which encourages a player to engage in various prompts along the board path to acquire needed cards to win—winning being the stated goal of the game, but for an engager, the true purpose being the engagement and development of trust and elicitation of responses along the path.
Figure 4:
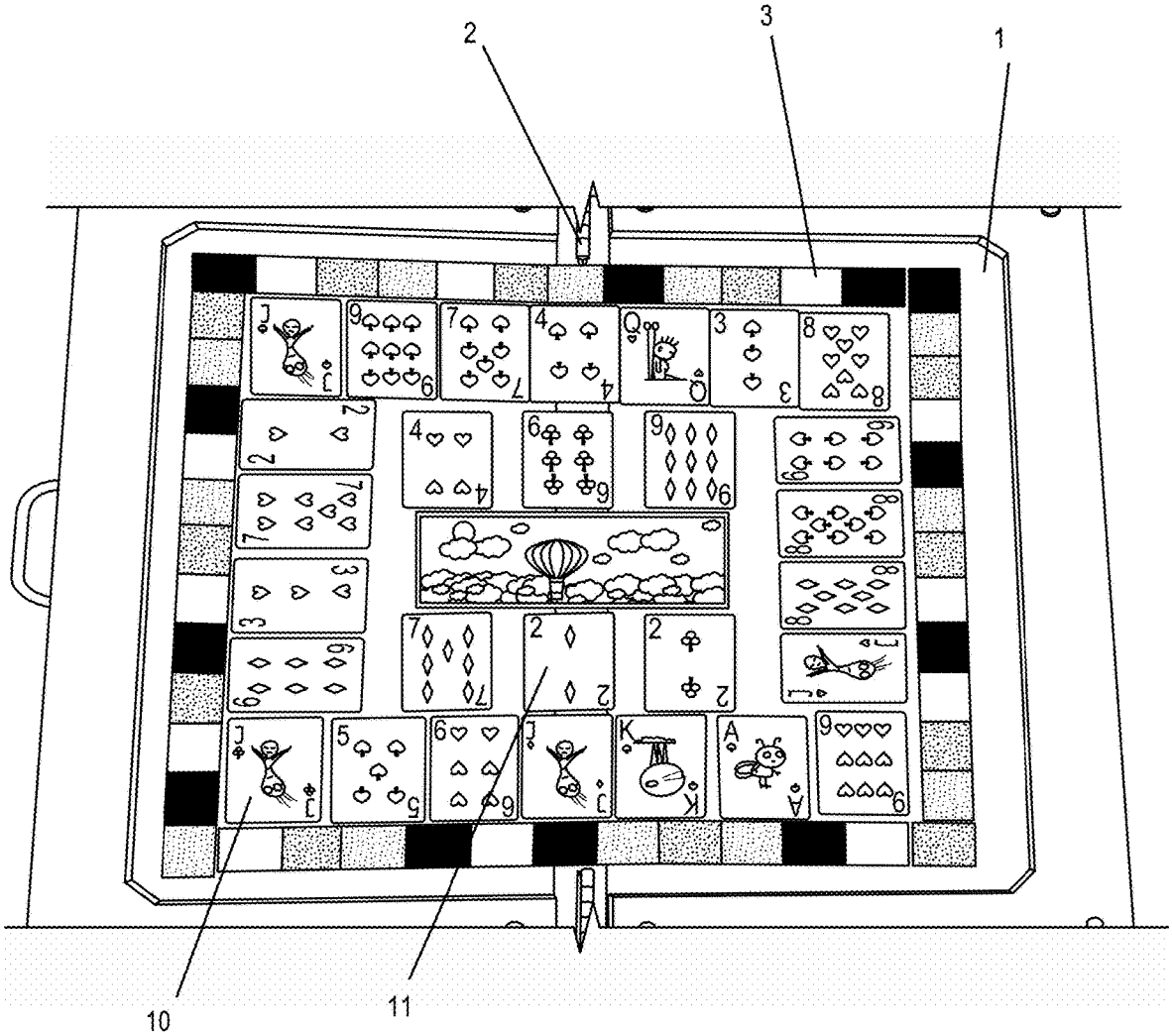
FIG. 4 depicts an alternate embodiment of a Templay Engagement Process board from an overhead view developed with traditional spaces but integrating the use of standard deck of cards wherein a player could "collect" cards to acquire a full hand according to any number of traditional card games (a poker hand, a gin rummy hand, for example), which encourages a player to engage in various prompts along the board path to acquire needed cards to win—winning being the stated goal of the game, but for an engager, the true purpose being the engagement and development of trust and elicitation of responses along the path. Shown here is also including a Choice Pile that offers additional opportunities for reward and prompt engagement (i.e., selecting a card from a choice pile by exchanging a content marker, landing on a space insert assigned a choice pile selection, etc.).

For example, referring to FIG. 1, there is a Templay Engagement Process game board (1) that folds up for storage and opens for play with hinges (2); whereupon during set-up, customizable spaces (3) are arranged in a desired orientation (compare for example, FIG. 1 and FIG. 2 for alternative potential arrangements); game components are chosen: dice (4), spinner (5), content cards (6), and questions cards (7). FIG. 2 depicts an alternate arrangement of the customizable spaces (2) and a carrying handle (8) and latch (9) to keep the board secure and easy to handle when put away and during transport. FIG. 3 depicts an alternate game play component as traditional playing cards (10) that can be used as described elsewhere herein. FIG. 4 depicts this same FIG. 3 arrangement, but with the use of inner piles of playing cards as choice cards (11), also used as described elsewhere herein.

In one embodiment, the engager will determine the rules that determine the measure to be used for determining a winner. For example, a winner could be determined objectively as the one who acquires the most tokens, or the most cards, or a particular value card, or points awarded, or spaces achieved along a path. A winner could also be determined subjectively as the one who is judged in various experiential or performances or reflections.

In one embodiment, the engager also determines the specific prompts to be integrated into the structure and game play process. These engagement prompts can be defined as being a purposefully developed medium for communication to serve as the basis for a supportive interaction. Prompts portray a concept or construct and may be used to elicit an experience and or process. Prompts may include pictures, songs, activities, etc. The prompt to be engaged in may be determined by spinning an engagement spinner. The engager might select engagement spinner inserts to represent each type of engagement prompt to be integrated in the game. For example, a picture of a mirror may be used to represent the Reflection Cards; a magnifying glass can represent the Concept Cards, etc. It is important to note that the engagement inserts can be adapted according to the engager's assessment of which engagement prompts are to be used.

Figure 5:
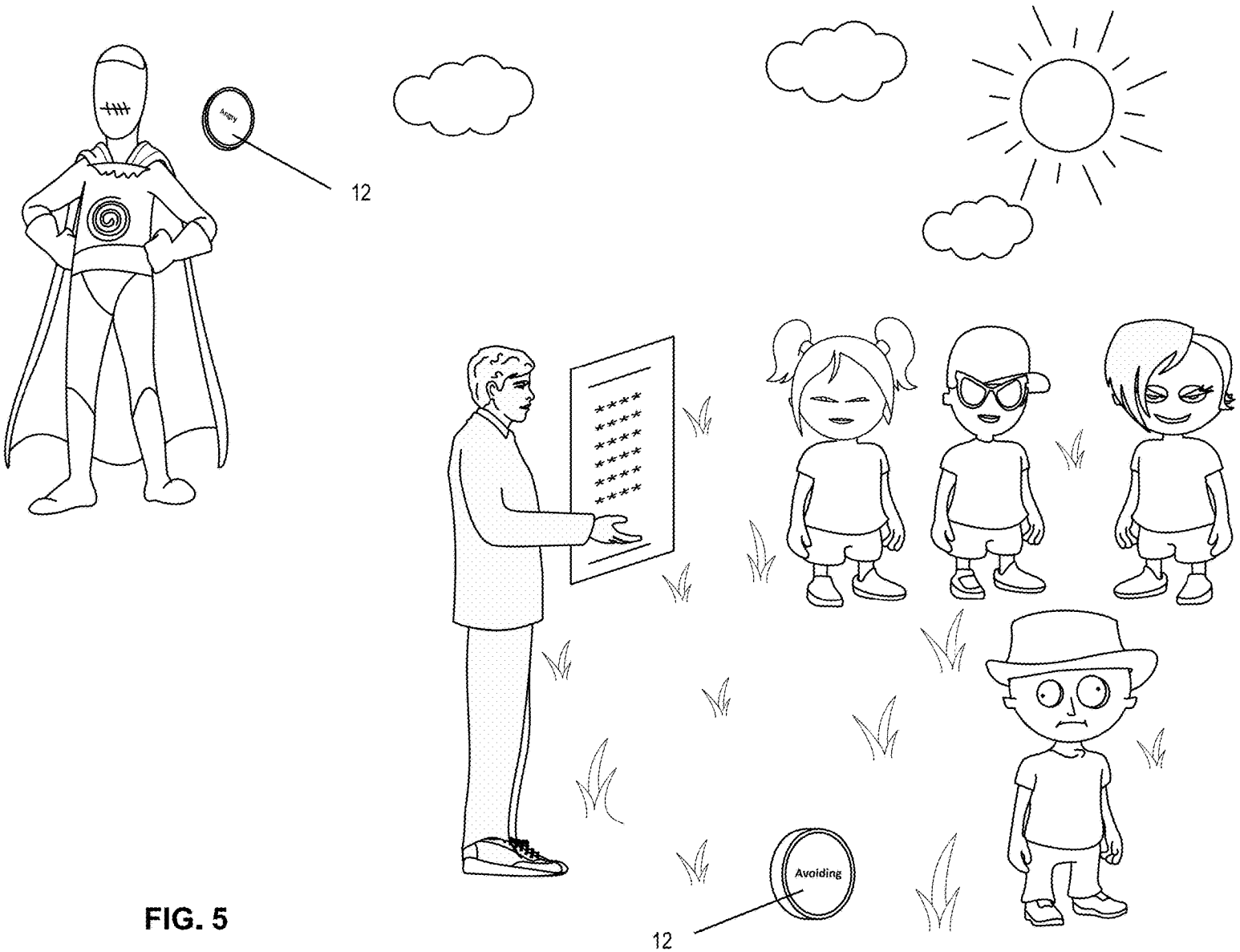
FIG. 5 depicts one embodiment of a Templay Engagement Process game play action wherein a player prompt or action dictates that player portray how a superhero may appear 'angry' or what 'avoiding' means to them in response to a content marker they are given.
Figure 7:
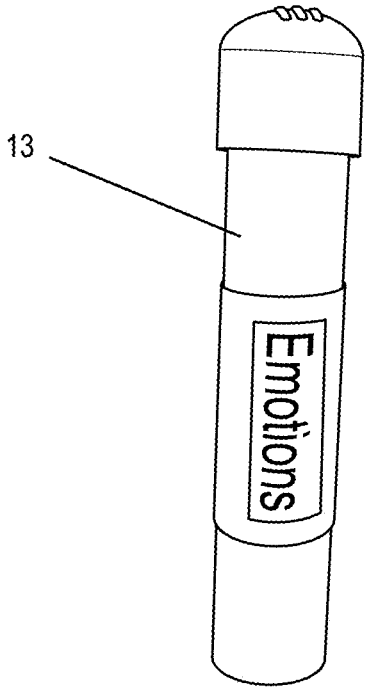
FIG. 7 depicts one embodiment of a Templay Engagement Process game component of a content marker selector.
Figure 8:
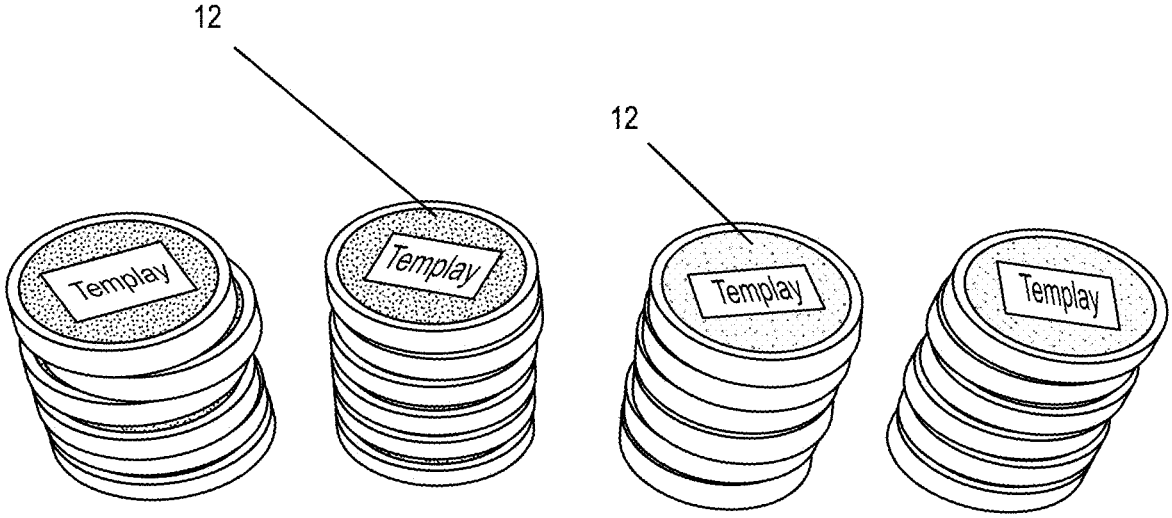
FIG. 8 depicts one embodiment of a Templay Engagement Process game component of Content Markers stacked for selection wherein in this example, one color could be for 'emotion' and another color for 'grief'. In this example, the Content Markers are color coded for differentiation during discretional application, as well as facilitating putting the game pieces away for future use.

In one embodiment, game play may utilize Content Markers (12) that depict a specific concept or construct, for example, emotion, action, term, and the like. The content may include professional and/or individual content material depending upon the purpose of the supportive interaction. Content Markers may be applied to Concept Cards and Reflection Cards as described below. They can also be used in determining the subject matter to be illustrated in other integrated activities such as body tracings (not shown) or in drawings as shown in FIG. 5 (wherein, an individual may be asked to draw a superhero according to the Content Marker labeled 'angry' or what 'avoiding' means to them. Content Markers may be utilized with a Content Marker Selector (13) as shown in FIG. 7 and/or by being placed face down in stacks as shown in FIG. 8. The benefit of making multiple stacks with the Content Markers face down is that the engager may organize the stacks into different categories (i.e. physical feelings and emotional feelings; emotions, actions and ideas; etc.) which offers the engager the ability to purposefully structure the Content Markers offered. For example, the offering of a Content Marker depicting an emotional feeling (i.e. anger, anxiety, etc.) may be more relevant, as compared to a physical feeling (i.e. hunger, cold, etc.) for the completion of a body tracing.

Figure 6:
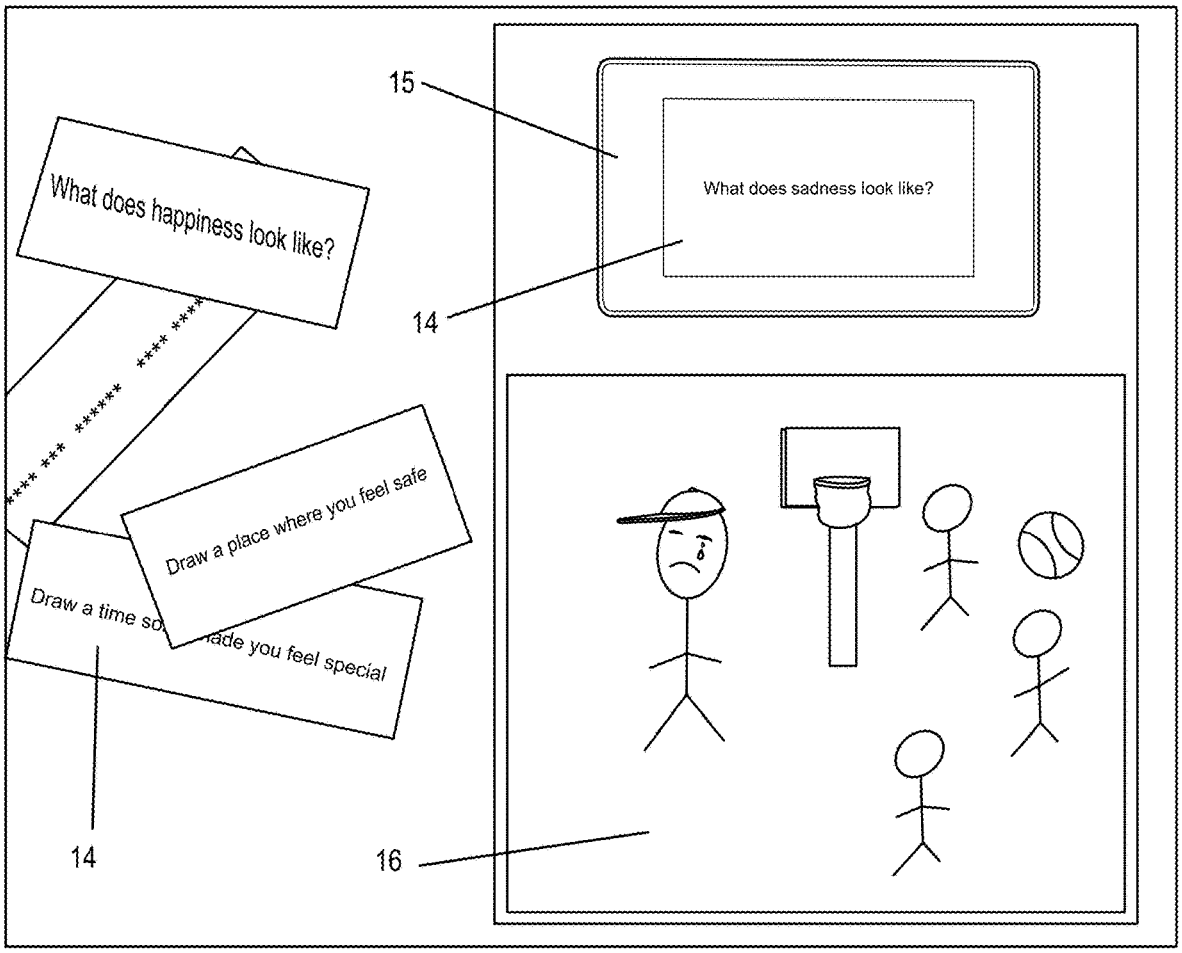
FIG. 6 depicts one embodiment of a Templay Engagement Process game play action wherein a player faced with an expressive arts prompt provides a written response. In this particular embodiment, the expressive arts prompt is placed in a pouch that provides replaceability of differing expressive arts prompt cards and the written response can be performed on a dry erase surface.

In one embodiment, engagement prompt categories and their related purposes include question cards that may be customized and purposefully included, or not, at the discretion of the engager. Referring to FIG. 6, question cards (14) may be reusable and interchangeably placed into a pouch (15) to prompt the individual player to draw their response on a white-board (16).

In one embodiment, it may sometimes be beneficial to arrange questions in a specific order to structure the educational and/or supportive interaction as some concepts or questions may be more comprehensive if other information and/or experiences are explored first.

In one embodiment, there could be Traditional Question Cards, and the engager could read the card verbatim and then support the participant in thoroughly exploring the answer. Non-limiting examples of Traditional Questions Cards include but are not limited to: where do emotional feelings come from?; who do you talk to about your physical feelings?; who helps take care of you when you're not feelings well?; and where do physical feelings come from?

In one embodiment, an engager works with a participant to explore the actual meaning of the question on a given Question Card as well as the development and explanation of the answer offered, regardless of who drew the card. This means that an engager describes their decision-making process and reasoning as thoroughly and interactively as during the participant's turn. For example, if the question posed is "Where do emotional feelings come from?", the engager would use age-appropriate language and metaphors to explore the concept of emotions (i.e. being sad as compared to having a sprained ankle, etc.), the physiological experience of emotions, internal and external stimuli (situations, thoughts, sensations, etc.).

In one embodiment, there could be Situational Question Cards, that an engager must first read to themselves to preview the question being posed and which part of the question is meant to be customized to the situational context of the engagement and/or their assessment of what would be most relevant to the participant. Non-limiting examples of Situational Question Cards include: If you're feeling (insert emotion here), what do you do?; If you're feeling (insert emotion here), who do you tell?; Tell me about a time when you felt (insert emotion here); and Tell me about a time when you did something that made someone else feel (insert emotion here).

In one embodiment, the use of Situational Question Cards to explore emotions could include, for example, the situation of a participant being supported in bereavement and has been reportedly experiencing behavioral manifestations of grief and having difficulty with behavioral management and redirection, an engager may determine that experiences of anger and anxiety may be more relevant than being surprised and/or jealous. In this situation, the engager "fills in the blank" accordingly and works with the participant to explore the actual meaning of the question as well as the development and explanation of the answer offered, regardless of who drew the card. This means that the engager describes their decision-making process and reasoning as thoroughly and interactively as during the participant's turn. The emotion, concept, etc. to be explored may also be determined by selecting a Content Marker as described elsewhere in this disclosure.

In one embodiment, there could be Character Questions Cards, wherein, an engager must first read the card to themselves to preview the question being posed for which parts of the question is meant to be customized to the situational context of the engagement, their assessment of what would be most relevant to the participant and/or ask the participant the specific material needed to "fill in the blank". Non-limiting examples of Character Question Cards include: what do you think is (insert Character here)'s biggest fear? Why do you think that is?; If a (insert individual Participant loves here) was (insert emotion here), what do you think (insert Character here) would do?: If (insert Character here) was playing with (insert participant's favorite toy here) and someone took it away, how would the (insert same Character here) feel? How should they handle it?.

In one embodiment, the Character to be reflected on during the exchange can be determined at the engager's discretion. For example, if a superhero theme is being utilized, the engager can select a superhero character (i.e. Wolverine, Arrow, etc.) to insert or ask a Content Question to give the participant the opportunity to determine which Character is discussed. For example, if the Character Question Card asks "What should (Character) do if he/she is (Emotion)?", the engager may determine "Anger" is the most relevant emotion to explore at that time. The engager may reflect on what personal content would be most beneficial to explore surrounding "Anger". Some examples of relevant content include coping strategies, healthy and unhealthy expressions of anger, violence versus self-defense, etc. A relevant Content Question Card may ask the participant in order to determine which Character to reflect on might be "Who is the strongest Superhero?" This would present an opportunity to direct the interaction to a discussion surrounding the risk of unhealthy expressions of anger (i.e. aggression, violence, etc.), as well as healthy methods of expression, during the exchange. The engager "fills in the blank(s)" accordingly and works with the participant to explore the actual meaning of the question as well as the development and explanation of the answer offered, regardless of who drew the card. This means that the engager describes their decision-making process and reasoning as thoroughly and interactively as during the participant's turn. The engager would continue to explore the participant's response surrounding what the chosen superhero would do and how their emotions would be expressed; the potential negative impacts of the expression on others; the potential impacts of expression on the participant; and other content relevant to the situational context of the supportive interaction.

In one embodiment, there could be Concept Cards that allow the participant to conceptualize engagement content; organize content into categories and compare and contrast ideas. The concepts portrayed on the Concept Card may be themes, groups, types, etc. relevant to the support content (i.e. physical feelings and emotional feelings, grief triggers and daily stressors, etc.). When the Concept Card prompt is used, the participant will select a Content Marker and discuss which concept (as portrayed by the Concept Cards) is related to the selected Content Marker. For example, if a Content Marker depicting "Anger" is selected and the Concept Cards being utilized are "Physical Feelings" and "Emotional Feelings", an engager supports the participant in exploring the difference between the physical and emotional feelings and determining which type of feeling (i.e. physical versus emotional) "Anger" is. The Content Marker may then be physically placed next to the appropriate Concept Card. Concept Cards can be customized by the engager according to situational context.

Figure 9:
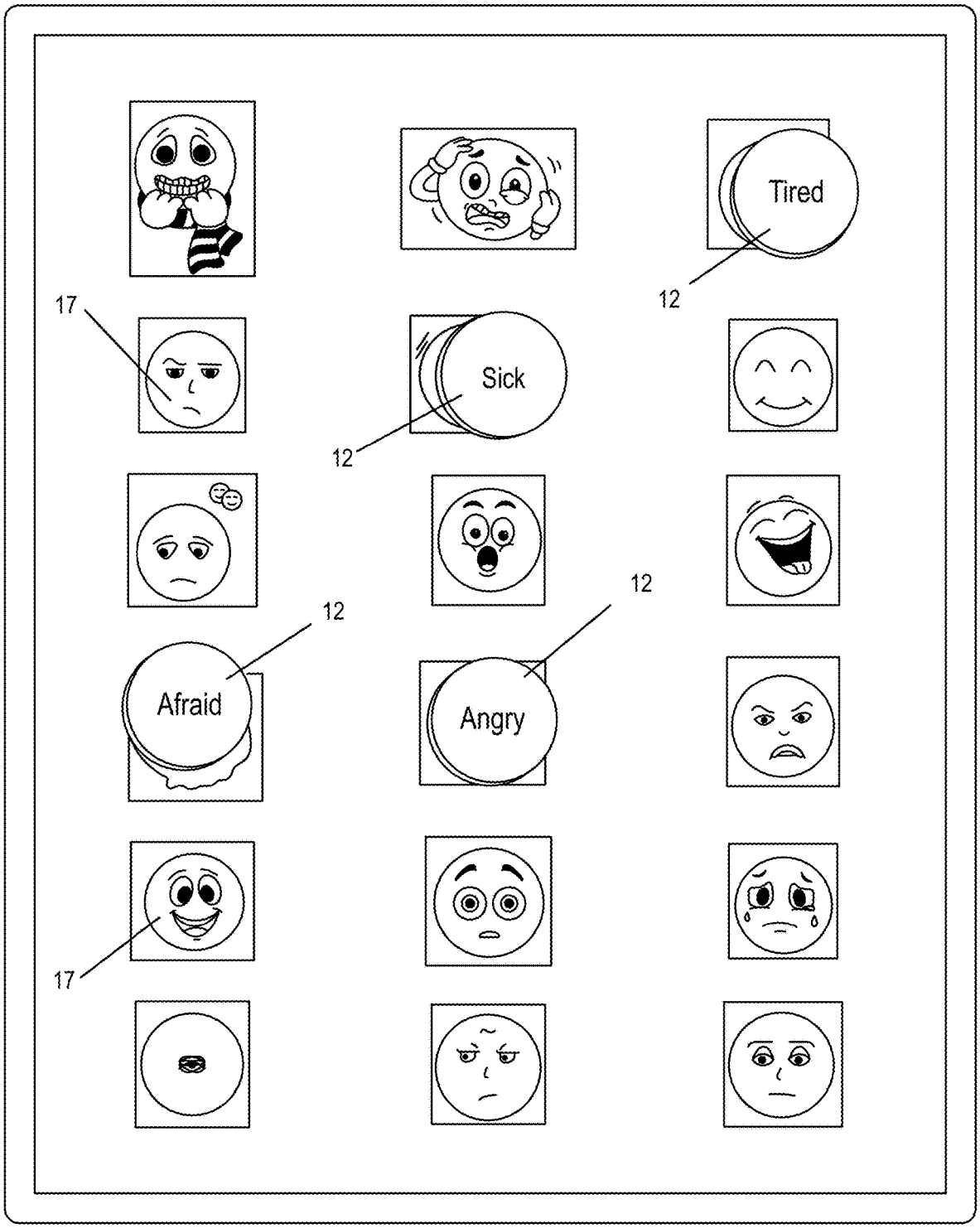
FIG. 9 depicts one embodiment of a Templay Engagement Process game component of a board containing various emojis representing a myriad of potential emotions and a player is asked to identify with Content Markers certain specific emotions.

In one embodiment, there could be Reflection Cards (17) that would be used as an expressive activity throughout the supportive interaction. Each card could include a variety of images. Reflection Cards can be customized into various themes (i.e. cartoon faces, pirates in different poses, etc.). A Content Marker is selected to be applied to the Reflection Card. The participant is supported in identifying specific components of support content (i.e. emotions, etc.) based upon their subjective interpretation of the images. For example, the youth may describe the facial features and/or body language of the character in an image which represent "Anger". The engager can also provide other information such as introducing the physiology of emotion, conflict resolution, etc. as a part of the exploration of content. The Content Marker (12) is then placed on the selected image on the Reflection Card (17) as shown in FIG. 9. The engager is encouraged to fully explore the individual's identification and/or projection of their experiences, decision-making processes, etc., related to the Reflection Card image and Content Marker regardless of which player drew the selected card. This means that the engager describes their decision-making process and reasoning as thoroughly and interactively as during the participant's turn.

Figure 10:
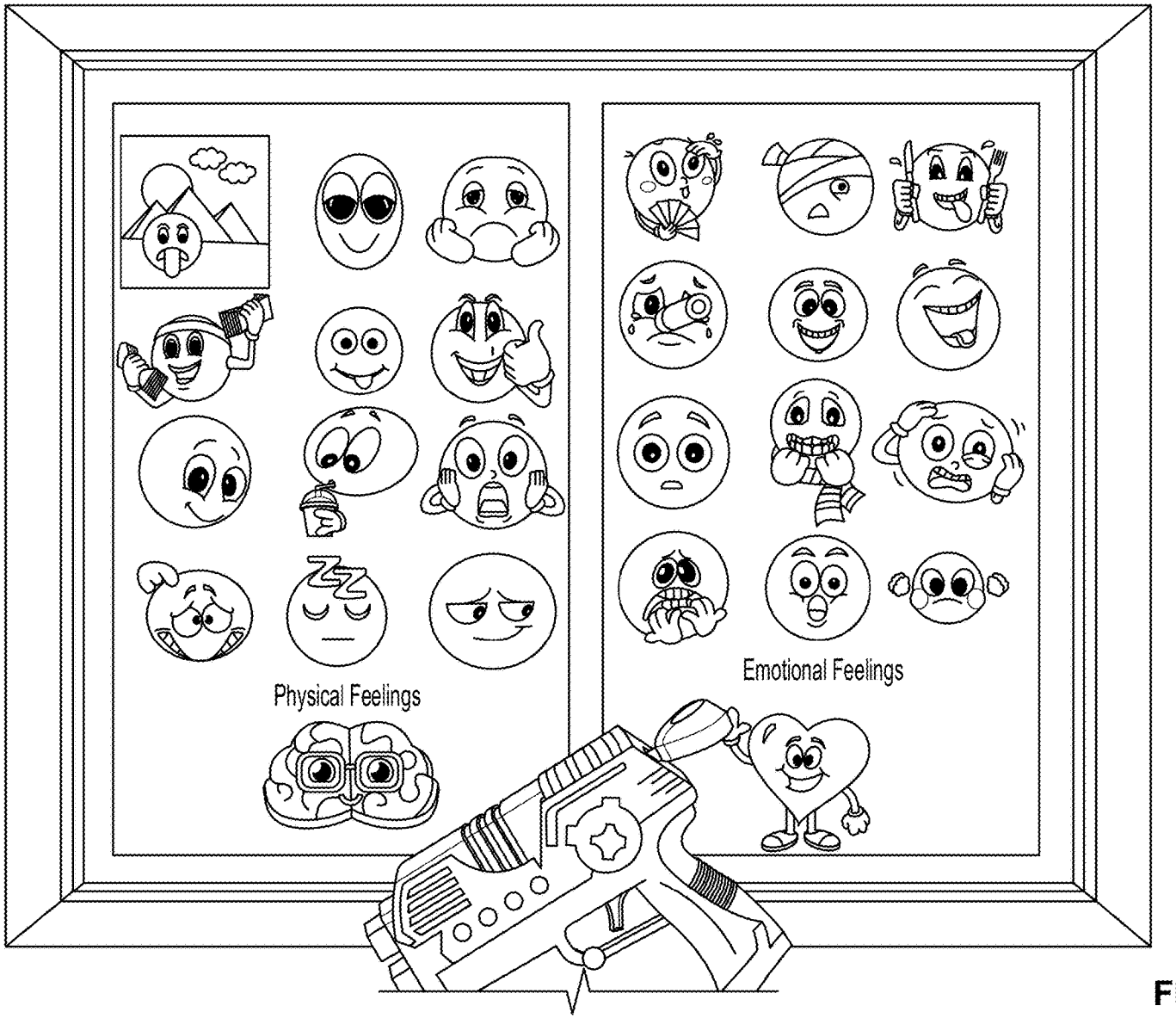
FIG. 10 depicts one embodiment of a Templay Engagement Process game component wherein a Reflection Card is integrated into a Content Prompt and a game player given the task of using a dart gun to target whichever image they believe is depicted in the selected Content Marker.

In one embodiment, the engager also has the option of printing larger copies of the Reflection Cards and integrating into Content Prompts as further described below. For example, the images may be placed in a frame and used as a target for the participant to shoot with a dart gun. The emotion on the Content Marker would be discussed and then the participant aims for whichever image depicts the selected Content Marker as illustrated in FIG. 10.

Figure 11:
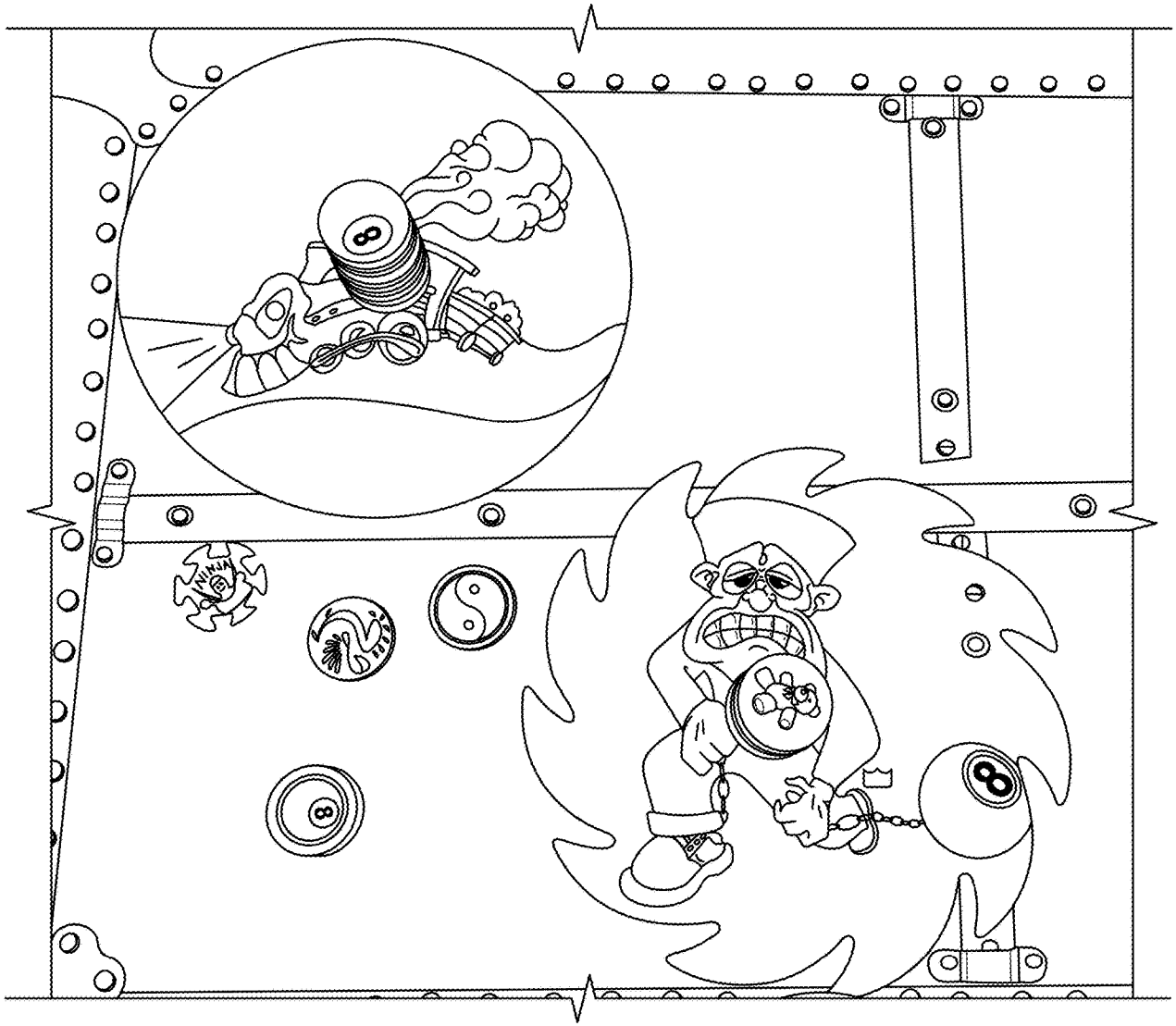
FIG. 11 depicts one embodiment of a Templay Engagement Process game play option wherein a peripheral prompt, in the form of a (previously existing) milk cap game, is used to allow the engager and the individual player to play something simultaneously to elicit skill building and problem solving.

In one embodiment, there could be a Peripheral Prompt, which would be any activity that specifically serves to keep the participant engaged throughout a supportive interaction and to elicit target experientials. The Peripheral Prompt is not directly connected to the substance of the supportive content and may include mini golf, darts, paper activities (i.e. drawings, word searches etc.), ring toss or any other short external engagement activity. The engager can explore problem solving and strategy formation surrounding the specific activity. For example, if "Pogs"; a milk cap game that involves stacking round milk caps in a pile and using a "Slammer" to try to flip over as many milk caps as possible (See FIG. 11), is being used as a Peripheral Prompt, the engager and participant can discuss different ways of holding the Slammer for better results. The engager also offers active validation and encouragement throughout the activities to promote esteem, rapport, risk-taking (i.e. trying a difficult task), coping with frustration and/or "failure", etc. Supporting the participant in following the rules of the Peripheral Prompts also offers structuring and opportunities to use supportive behavioral modification techniques (i.e. positive reinforcement, following direction, etc.). For example, building a simple model (approximately ten minutes or less to assemble) offers an explicit opportunity to structure the individual in educational processes and any associated frustration, gratification, etc.

In one embodiment, there could be Content Prompts that are activities that illustrate a specific concept, idea, etc., that is relevant to the situational context of the supportive interaction. These activities can be related to evidence-based interventions (i.e. Cognitive Behavioral Therapy and Automatic Thoughts, Dialectical Behavioral Therapy and Mindfulness, etc.). An example of Mindfulness activity is to have the participant hold an M&M® candy and focus on the physical sensation of it in their hand and describing it. The participant is then prompted to place the M&M® candy in their mouth and focus on the physical sensation of the candy in their mouth, flavor, process of moving it around in their mouth, etc. The participant describes their experiences of their senses accordingly. The concept of Mindfulness is comprehensively defined and discussed with the participant throughout the activity. Another example of a Content Prompt is to use a remote-control car as a means to explain the role of motor neurons in human biology. The remote control communicating with the car "engine" can be metaphorically compared to the brain communicating to individual muscles, body parts, processes, etc. through motor neurons.

Figure 12:
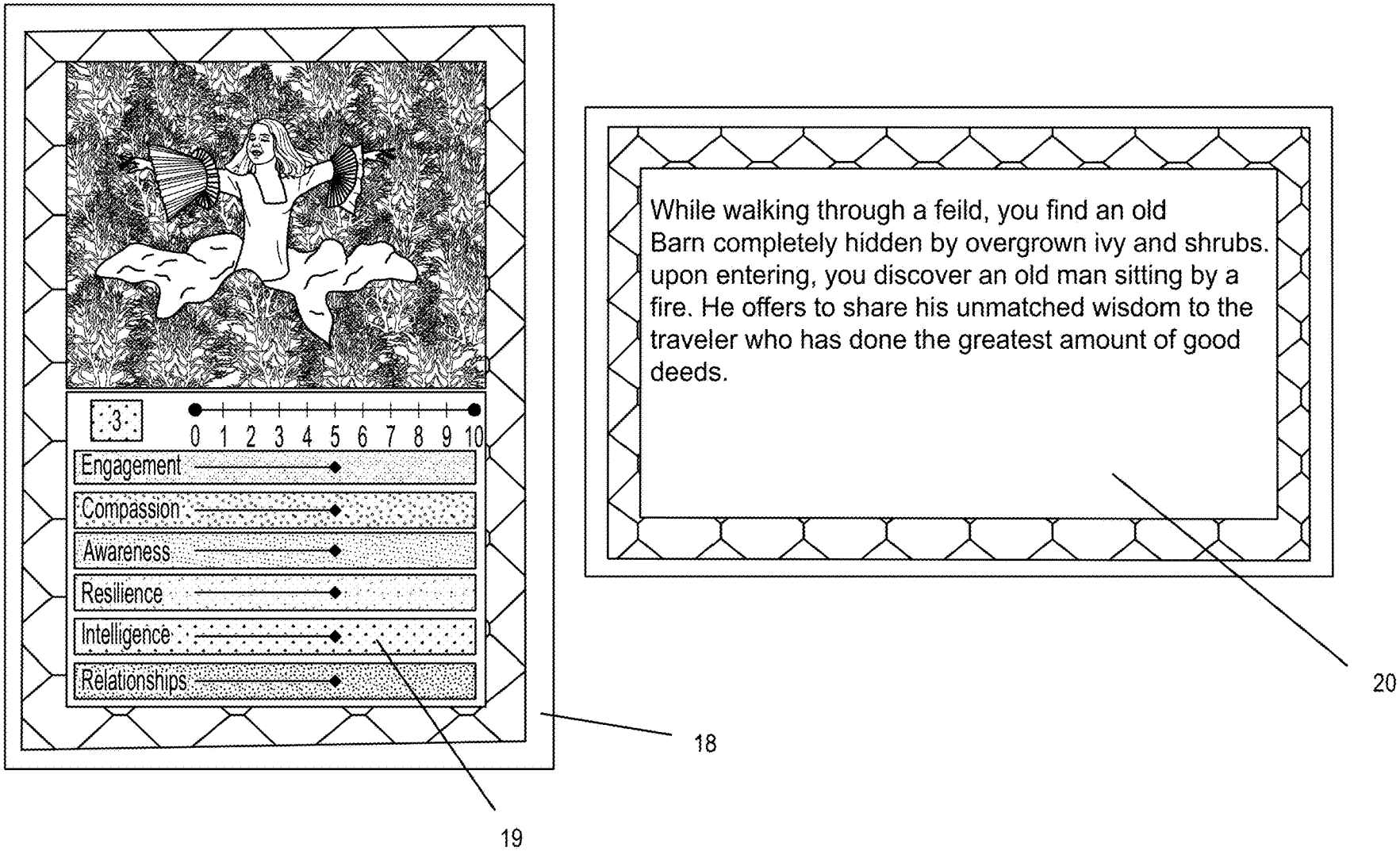
FIG. 12 depicts one embodiment of a Templay Engagement Process game component in the form of a storyline Character Card combined with a Designated Event Card wherein the storyline character card comprises individual various attributes specific to a storyline character and the event card is related to the storyline. In this embodiment, reference to storyline as a storyline character is simply a differentiator to other types of character cards (i.e., combative, sports, etc.) and is merely a character that fits into the narrative, and not defining the narrative itself.
Figure 13:
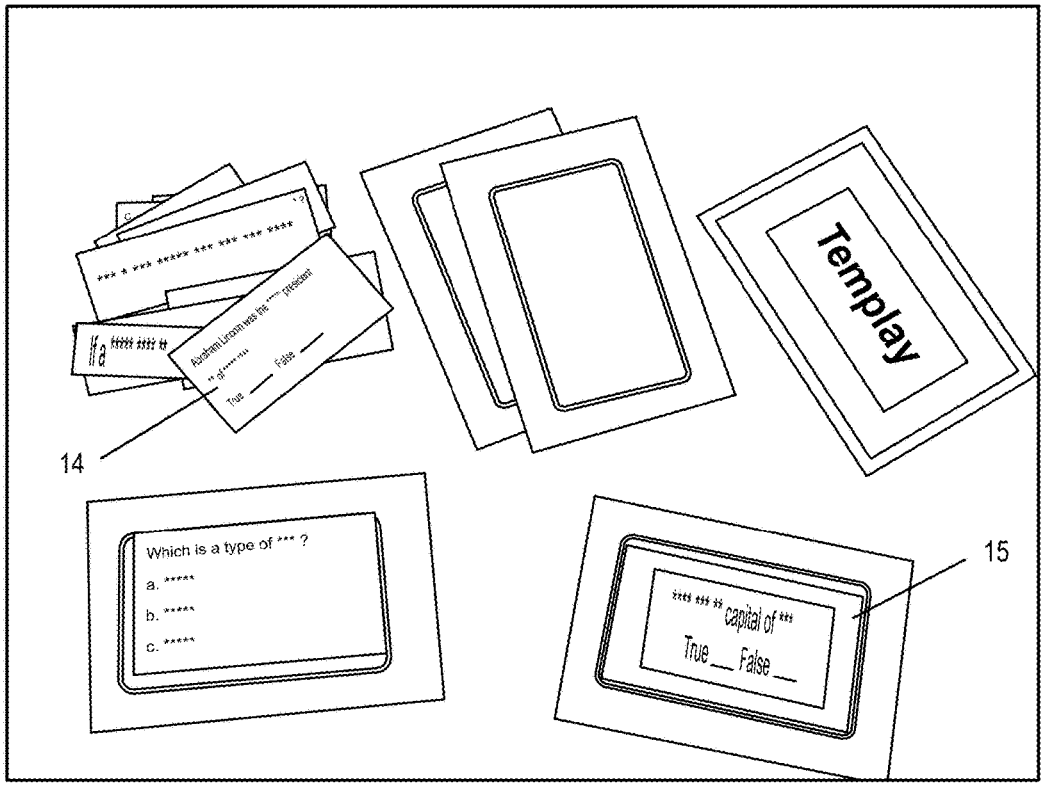
FIG. 13 depicts one embodiment of a Templay Engagement Process game component wherein certain cards querying true/false questions or multiple choice questions can be interchangeably placed into see-through sleeves and the engager can prompt the individual player to mark with dry-erase onto the erasable sleeve and would be Marking Question inserts.
Figure 14:
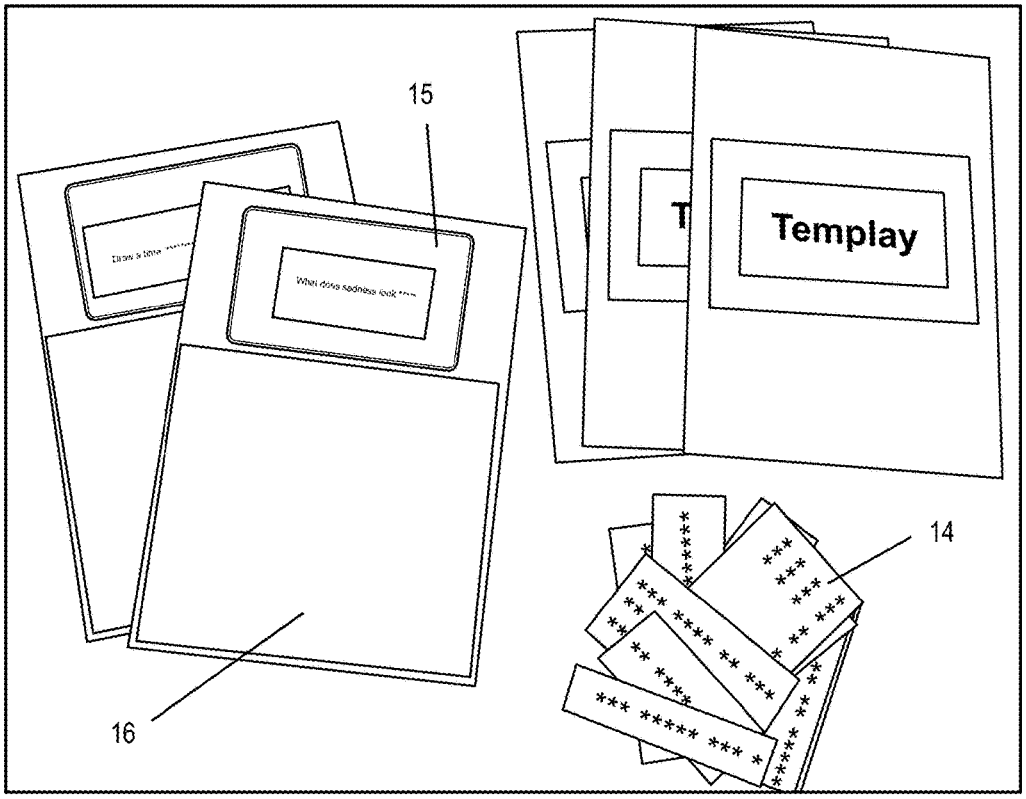
FIG. 14 depicts one embodiment of a Templay Engagement Process game component wherein certain cards prompting the individual player in more complex answers or artwork, are interchangeably placed into the see-through sleeves, but in this embodiment, there is a larger white dry-erase surface for the response.
Figure 15:
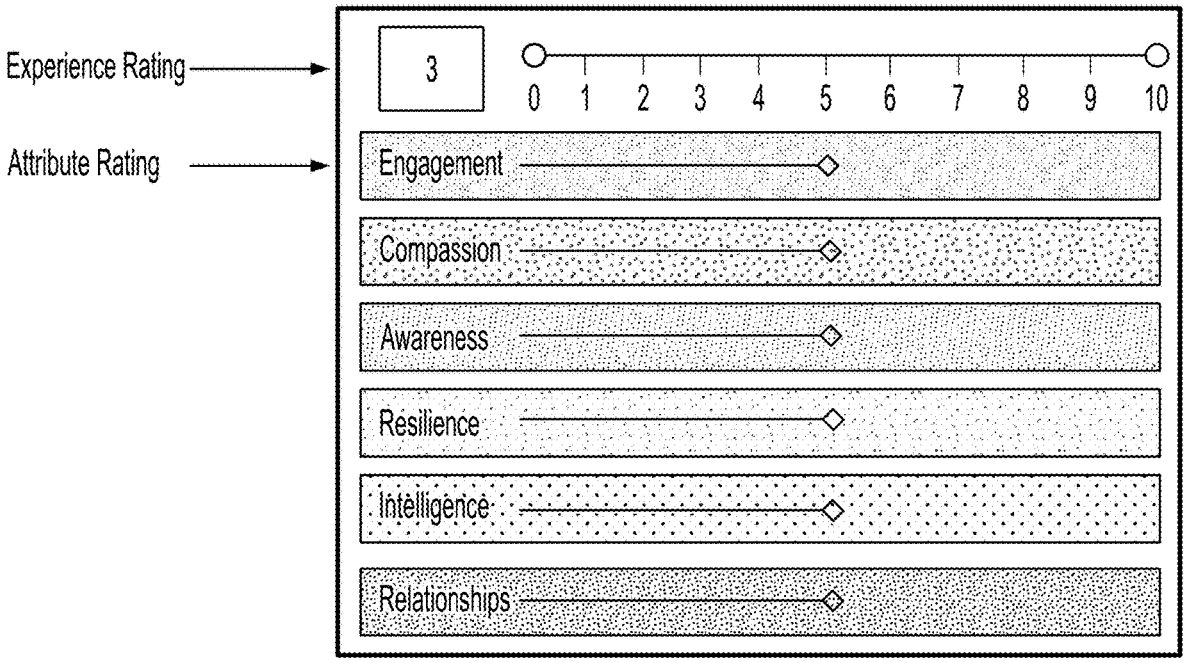
FIG. 15 depicts one embodiment of a Templay Engagement Process game component showing a close up of a representative storyline character card and its various attribute ratings and experience that will become important in game play.

In one embodiment, there could be Character Cards (18), utilized in a face-off structure. They would portray an image of a character with a Character Rating Chart (19) that illustrates the Character's individual attributes. Individual Attributes for Combat Characters (wizards, super heroes, soldiers, etc.) include engagement, speed, strength, resilience, intelligence, and alliances. The Attributes included on Sports Character Cards are engagement, speed, stamina, accuracy, strategy and teamwork. The Attributes included on Storyline Character Cards are engagement, compassion, awareness, resilience, intelligence and relationships. See FIGS. 12 and 15, for example. When a face-off is triggered, the Character Cards are placed on the board in accordance with a particular game structure set of rules. A Designated Event Card (20) is drawn and offers a specific scenario. For example, a Combat Designated Event Card is "As you reach the top of Mt. Sinai, you discover a treasure being protected by a devious Troll. An opposing Sorcerer, who also covets the treasure, appears at the same time. The Troll states he will offer a riddle. The warrior who answers the riddle correctly will be awarded the treasure, the other will be made his slave." The participant and engager then discuss which specific Attribute (i.e. Compassion, Resilience, etc.) would be most relevant to success in the drawn scenario. In the provided example, Intelligence would be the most relevant Combat Character Attribute for answering a riddle. The engager and participant discuss why Intelligence would be more beneficial than strength, speed, etc. The engager may explore real life experiences which would require the similar attribute and/or ask the youth for examples in their life when their intelligence was beneficial to a given situation over their strength or physical prowess and how they went about resolving the problem, conflict, etc. After the determination is made which Attribute will be the measure for winning the face-off, each player will select one of the cards from their bank to play against the other player(s). The player whose card has the highest measure for that Attribute Rating will win the exchange. Depending on the game structure being used, the number depicted by the Experience, Spoils, or Stats Rating (depending on whether Combat, Sports, or Storyline Character Cards are being used) of the defeated player's card will determine the number of Currency received by the "victor". Characters with higher ratings have higher Experience, Spoils and Stats ratings.

In one embodiment, there could be a platform for engagers to develop their own Character and Designated Event Cards through a digital template. This platform enhances the customizability of the Templay Engagement Process game. The digital template platform offers templates to edit and print customizable Questions Cards, Concept Cards, Content Markers, and Reflection Cards. This allows engagers to directly integrate personalized subject matter as fixed content for that participant. This integral component reduces the need for the engager to introduce concepts or direct a discussion because now it is already included as a fixed part of the game prompts. In this manner, emotionally provocative and generally uncomfortable subject matter is made less intimidating and distanced as just part of the game.

Figure 16:
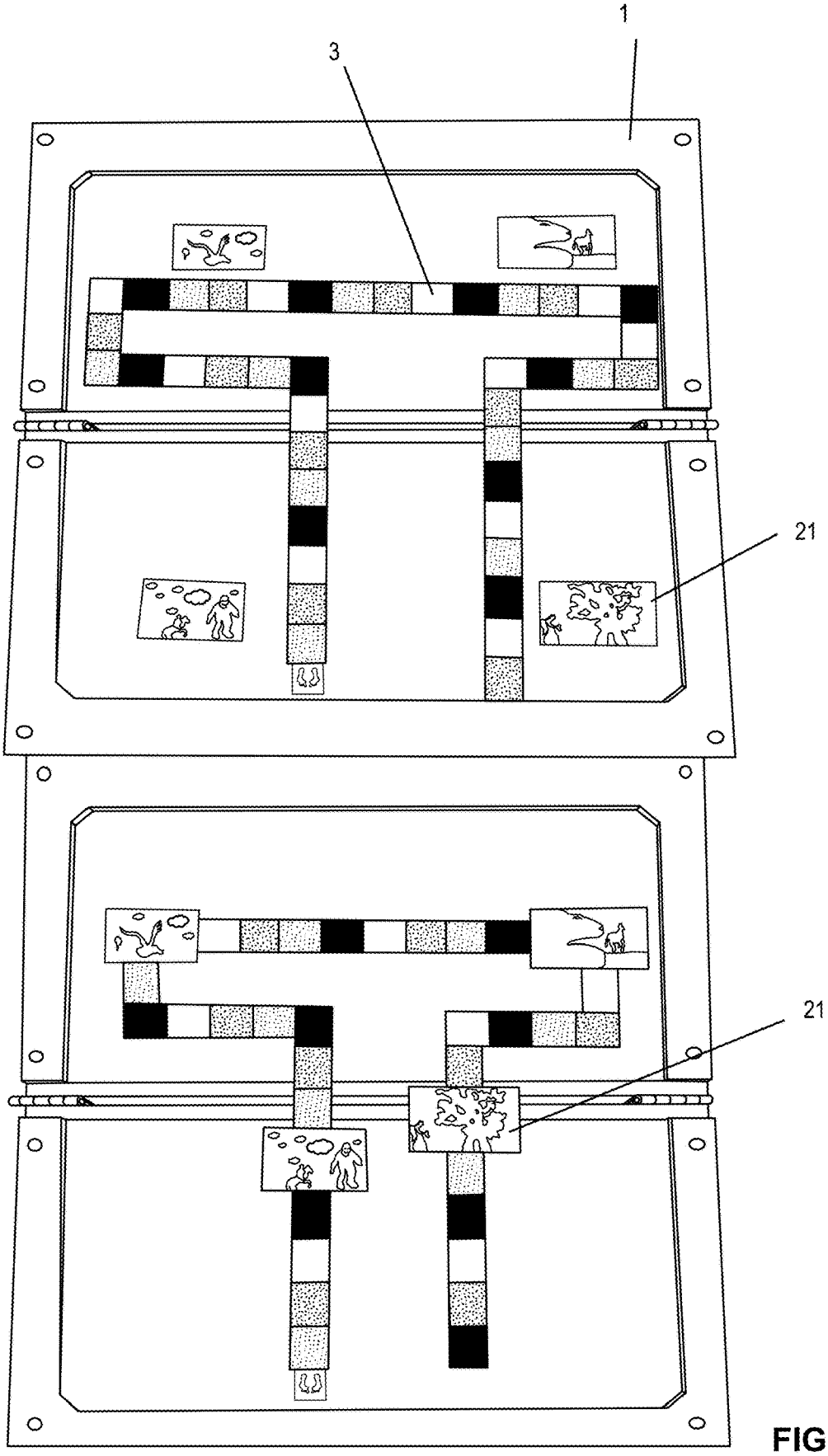
FIG. 16 depicts two potential embodiments of a Templay Engagement Process game board set-up wherein structure inserts are utilized as aesthetic inserts around a possible game space path or as procedural inserts within a possible game space path.

In one embodiment, there could be a collaborative building of the game board structure. In this process, the engager begins by having a participant select a theme (i.e. pirates, outer space, etc.). The engager provides the participant with the structure inserts (21) relevant to the selected theme. The engager then provides the participant with the Templay Spaces and structures them in designing the layout of the board. See FIG. 16. The engager and participant discuss whether the Structure Inserts are Aesthetic or Procedural. If aesthetic, they are not attached to the Templay Spaces and are not a part of the game process. If they are procedural, they are integrated into the Templay Spaces and may be associated with a Designated Event. See FIG. 16. For example, if a Dinosaur Theme is being utilized, a Procedural Structure Insert which depicts a Volcano may result in a player losing Currency and/or being moved backward if landed on. The engager supports the participant in the decision-making process through game board development.

Figure 17:
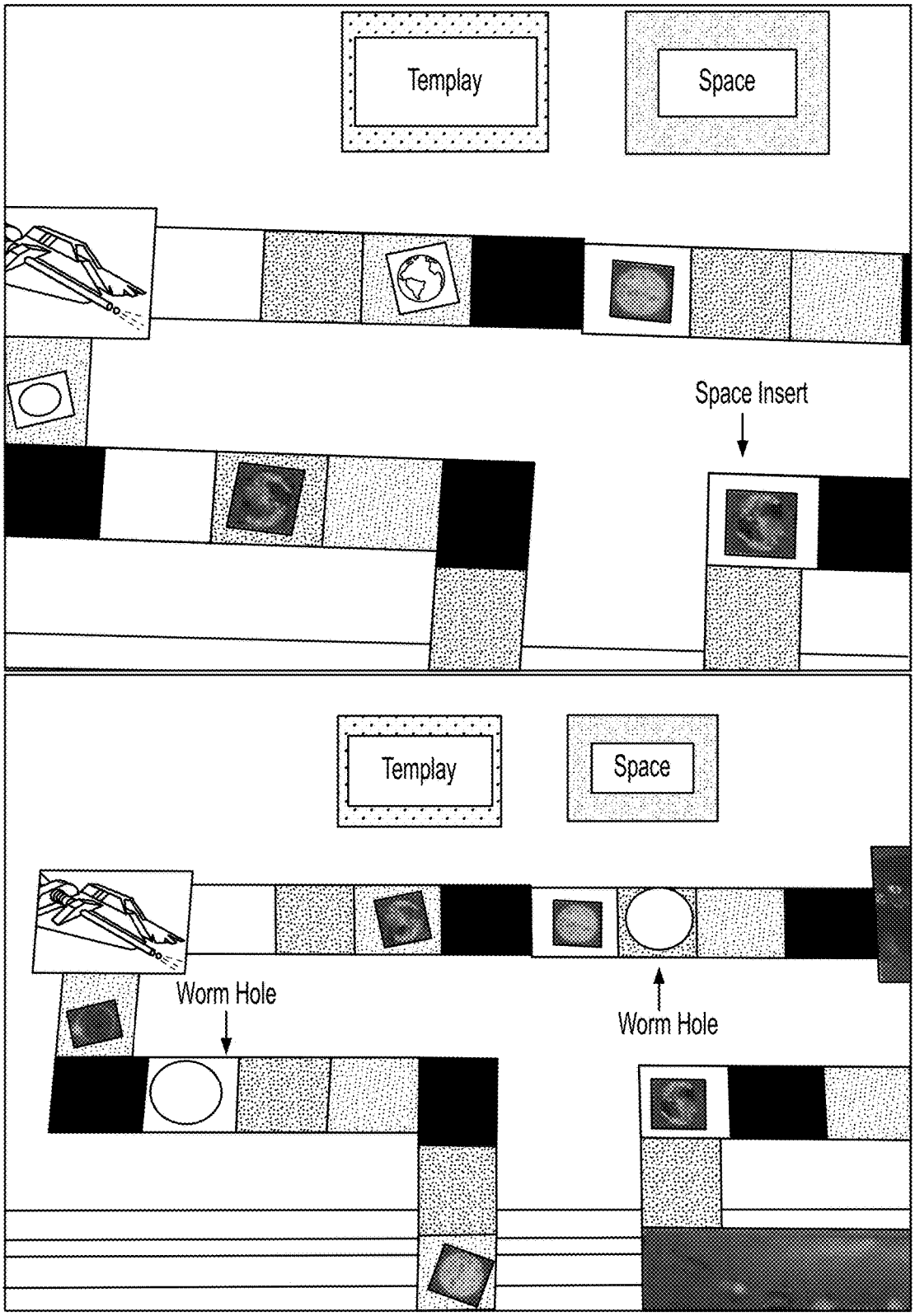
FIG. 17 depicts additional embodiments of a Templay Engagement Process game board space path set-up wherein spaces could contain game components such as earth or corrupt planet inserts or worm-hole inserts, that each could have varying effects when landing on such a space during game play. The specific effects could be determined during game board set-up.

In one embodiment, the engager then provides the participant with the Space Content Inserts, which can portray a variety of different images, words, etc., that can be assigned Designated Events. For example, if using an Outer Space Theme, landing on a space with a Space Content Insert depicting Earth may result in gaining a currency. See FIG. 17. In another example, landing on a space with a Worm Hole could result in the players ability to jump ahead to the next space with a Worm Hole. See FIG. 17.

Figure 18:
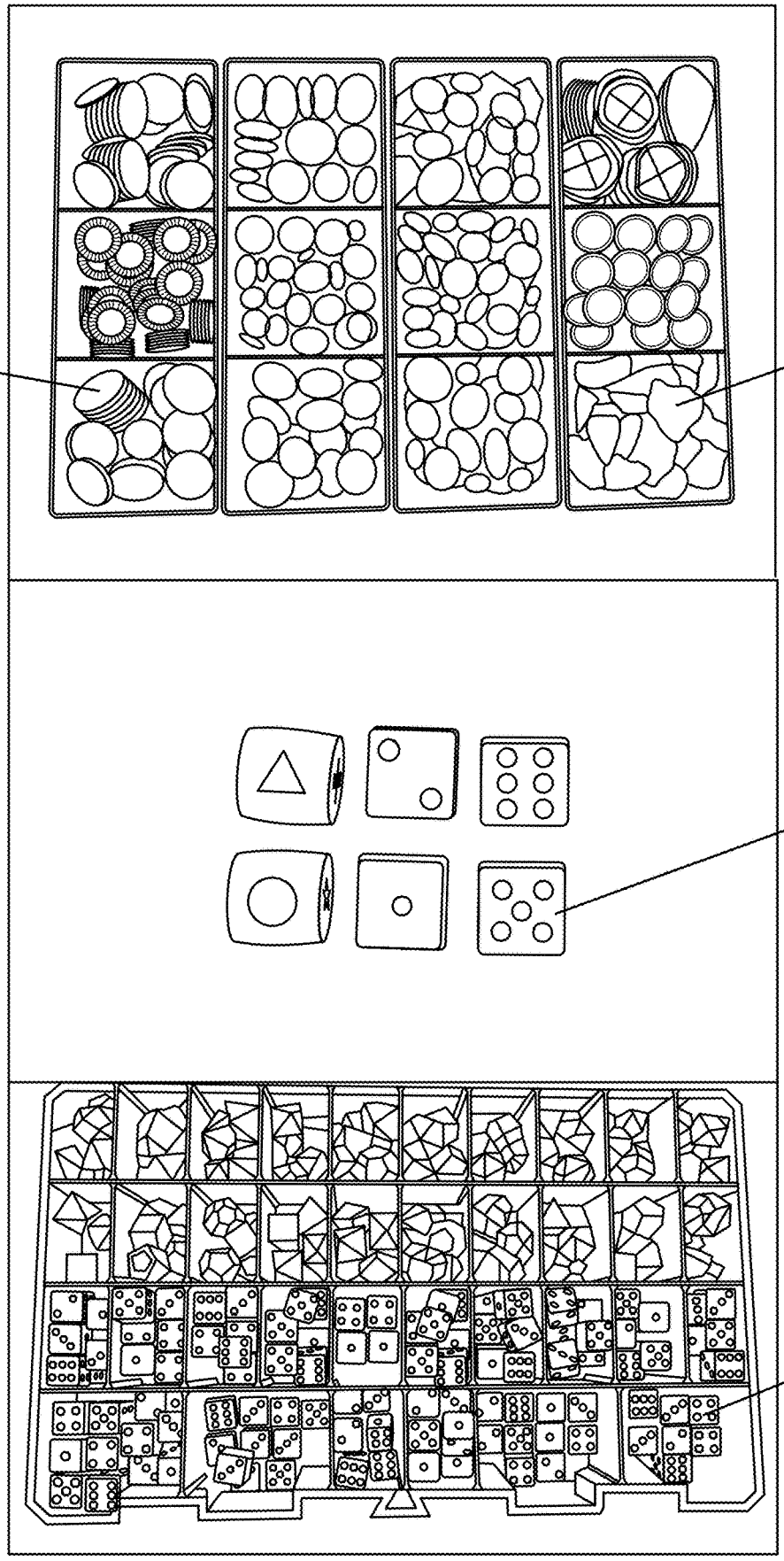
FIG. 18 depicts various embodiments of markers and dice and game currency that could potentially be used in a Templay Engagement Process game set-up.
Figure 19:
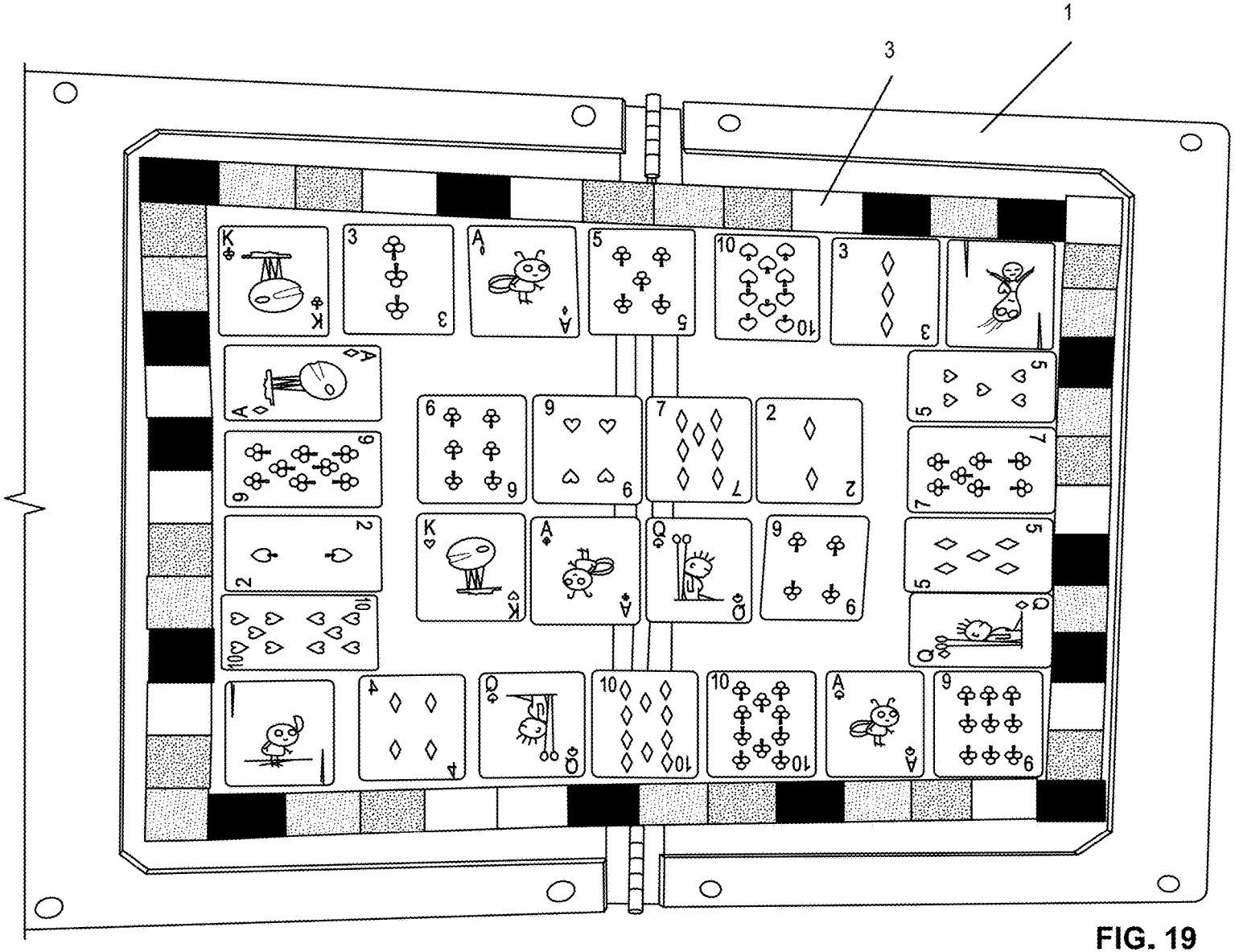
FIG. 19 depicts one embodiment of a Templay Engagement Process game set-up with a board structure being utilized with standard playing cards for poker, or blackjack or any card game desired.

In one embodiment, the participant is then provided the opportunity to select a type of Currency (22) (i.e. tokens, coins, gems, etc.) to be used, as appropriate. See FIG. 18. The Templay Board would come with Stock Tokens as Currency, however the engager is encouraged to accumulate various other types of currency to integrate into different Themes. (i.e. Gold Coins for the Pirate Theme, Gems for the Mythical Theme, etc., Shells for a Nautical Theme, etc.).

In one embodiment, the participant then selects a means for chance determination to be used, such as dice (4) (and what type of dice), spinner (5), etc. See FIG. 18. The participant may attach Designated Events to different Dice, as appropriate. For example, a numerical die could be used to determine the number of spaces advanced, while a die with Shapes on it, or of a different color, can be used to determine an action or event such as selecting a Question Card, Spinning the Engagement Spinner, taking an extra turn, not advancing during that turn, etc. The Templay Board would come with a stock variety of dice. See FIG. 18. However, the engager is encouraged to accumulate and implement a variety of other types of dice or other choice determination means, such as for example, a random number generation tool, to enhance Game Structure Options and Customizability.

In one embodiment, the participant then selects Game Pieces to be used. The Templay Board would come with standard game pieces. The engager is encouraged to acquire additional small figurines to integrate into their themes as a part of their Templay Engagement Process game kit. Any figurines may be used with the Templay Board. Figurines may also be used as Space Inserts and associated with Designated Events such as needing to roll above a certain number in order to be able to pass the figurine, losing currency, losing a turn, etc. Depending upon the resources of the engager, it may be beneficial to have the participant select a Game Piece to keep and have them be responsible for bringing it home and back to future meetings. This is an example of Integrating an external experiential with the Templay Engagement Process and can be utilized in a variety of therapeutic modalities and interventions.

In one embodiment, the engager and participant will review and confirm the rules of the Templay Engagement Process game as chosen prior to initiating play. Changes to rules during game play may be allowed, depending on engager assessment. For example, if a participant is easily structured and the target experientials do not include decision-making, behavior modification and/or redirection, etc., allowing the participant to change the rules throughout the game may enhance their investment in the supportive interaction, as well introduce other types of interactional opportunities. For example, if the youth asks to add a Designated Event of a Dinosaur "attacking" any player who lands on the associated space, the engager could briefly introduce the concept of conflict, aggression etc. If behavior modification and/or consistency is included in the target experientials, the engager may choose to not allow the youth to change the rules but state that the rule can be added at their next session. The participant can then be supported in any experiences of frustration, disappointment etc. by being offered positive reinforcement and information surrounding the benefits of consistency, predictability, follow-through (i.e. motivation) etc.

In one embodiment, the engager and participant build the board and collaboratively develop the game structure as previously described. The game is played traditionally in accordance to the rules developed by the engager and the participant. The players take turns rolling the dice or using any other designated game play directive and engaging in the designated prompts, activities etc. (i.e. Question Cards, Reflection Cards, Peripheral Prompt, etc.). An Engagement Spinner could be used to determine which prompt is completed during each turn. One token is awarded after each successful turn unless otherwise determined by game rules developed by the participant (i.e. landing on a space which does not allow the player to receive a Currency, etc.). The winner is determined as previously described.

In an alternative embodiment, the engager and participant build the board and collaboratively develop the game structure as previously described. The game is played discretionally in accordance to the rules developed by the engager and participant. The players take turns rolling the dice or using any other designated game pay directive and engaging in the designated prompts, activities etc. (i.e. Question Cards, Reflection Cards, Peripheral Prompt, etc.) as previously described. The engager, however, purposefully determines which prompt is completed during each turn according to the Situational Context of the Supportive Interaction. The engager and participant each determine the Currency awarded to the opposing player according to their "rating" of the performance of the Engagement Prompt unless otherwise determined by game rules developed by the participant (i.e. landing on a space which does not allow the player to receive a token, etc.). For example the engager may offer three Currency in exchange for a fully developed response regarding an experience of frustration, while offering one currency for a less "complete" answer. This can promote "risk-taking" through an on-going process of positive reinforcement. The winner is determined as previously described.

In one embodiment, Templay Engagement Process game customizable spaces are arranged in a square around the perimeter of the Templay Engagement Process game board with cards being used aligned along the inside of the spaces. The players take turns rolling the dice and engaging in the designated prompts, activities etc. (i.e. Question Cards, Reflection Cards, Peripheral Prompt, etc.). One token is awarded after each successful turn unless otherwise determined by game rules developed by the participant (i.e. landing on a space which does not allow the player to receive a token, etc.). An Engagement Spinner may be used to determine which prompt is completed during each turn. The player places the card associated to the space they land on in their Card Bank. Three Currency may be exchanged for cards in the Choice Pile. The winner is determined as previously described.

In one embodiment, Templay Engagement Process game customizable spaces are arranged in a square around the perimeter of the Templay Engagement Process game board with the cards being used aligned along the inside of the spaces. The players take turns rolling the dice and engaging in the designated prompts, activities etc. (i.e. Question Cards, Reflection Cards, Peripheral Prompt, etc.). The engager purposefully determines which prompt is completed during each turn according to the Situational Context of the Supportive Interaction. The engager and participant each determine the Currency awarded to the opposing player according to their "rating" of the performance of the Engagement Prompt unless otherwise determined by game rules developed by the participant (i.e. landing on a space which does not allow the player to receive a token, etc.). For example, the engager may offer three Currency in exchange for a fully developed response regarding an experience of frustration, while offering one currency for a less "complete" answer. This can promote "risk-taking" through an on-going process of positive reinforcement. The player places the card associated to the space they land on in their Card Bank. Three Currency may be exchanged for cards in the Choice Pile. An Engagement Spinner may be used in the "engagement" capacity, meaning that it would determine different activities (Question Cards, Reflection Cards, Peripheral Prompt, etc.). The winner is determined as previously described.

In one embodiment, the Templay Engagement Process game may incorporate, any type of card (sports, characters, Trading Card Games, etc.) and using either a traditional or discretional application. The Templay Spaces are arranged in a square around the perimeter of the Templay Board with the cards being used aligned along the inside of the spaces. The players take turns rolling the dice and engaging in the designated prompts, activities etc. (i.e. Question Cards, Reflection Cards, Peripheral Prompt, etc.). The player places the card associated to the space they land on in their Card Bank. Three Currency may be exchanged for cards in the Choice Pile. An Engagement Spinner may be used in the "engagement" capacity, meaning that it would determine different activities (Question Cards, Reflection Cards, Peripheral Prompt, etc.) to be engaged in after each roll.

In one embodiment, players collect enough cards for their deck to engage in a Card Game Match. For example, if using the Templay Engagement Process game board structure incorporating a poker embodiment, the players collect cards for their hand until each player has the five cards needed to play a hand of poker. The winner is determined as previously described. The Integrated Application may be utilized in conjunction with the Traditional or Discretional Applications as previously described.

Figure 20:
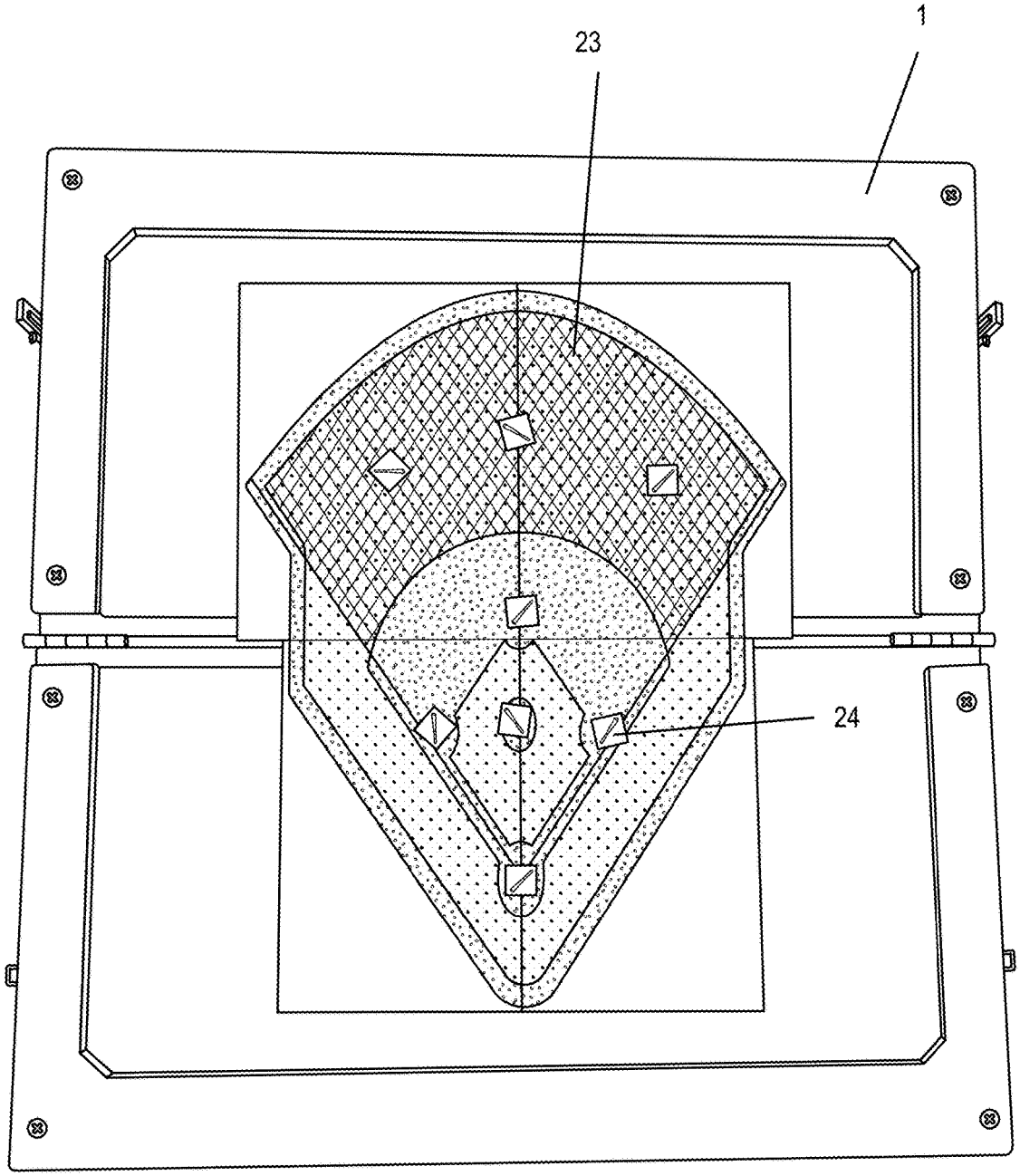
FIG. 20 depicts one embodiment of a Templay Engagement Process game set-up with a board structure implementing a baseball diamond and no traditional ladder type spaces as described in the above Figures. In this embodiment, there are draw points (bases and outfield positions) that could be thought of as non-ladder type spaces.

In one embodiment, the Templay Engagement Process game may include sports inserts (23) (i.e. baseball field, hockey rink, basketball court, etc.) and draw point inserts. The sports inserts are arranged on the Templay Engagement Process game board. The draw point inserts (24) are placed on the Board in accordance with the type of stadium. For example, when utilizing the baseball stadium sports insert, the draw point inserts are placed on all the bases, the pitcher's mound and three in the outfield. See FIG. 20. Game Pieces are used by the player on offense to mark their Team Members' place on the field. The "Pitch" occurs by drawing a Designated Event Card. A Face Off is completed as described elsewhere herein. If the player on offense plays the card with the highest Stats rating, the Draw Point from the pitcher's mound is added to their bank and the game piece is added to their bank and they advance that game piece to the first base. A Face Off occurs to allow for the advance. If the player on offense wins the exchange, the Draw Point is awarded to their bank and they are able to advance to the next base. If the player on defense wins the exchange, the offensive player cannot advance. Players are not removed from the board when they lose the exchange, but rather it becomes another batter scenario. Draw points are replenished before each turn at bat. The player on each base must win the exchange in order to advance to the next base and are awarded the Draw Point from the base they are advancing to. Players may only attempt to advance to the next base if the prior base(s) is/are occupied by a teammate. The Player on offense is awarded a total of three Draw Points when a player reaches home plate and wins that exchange (meaning the player is given two on top of the one they receive from the exchange). The player on defense can initiate a draw from the Outfield Draw points once every three draws. Outfield Draws Points are awarded to the victor and are not replenished after the exchange. When the player on defense wins five exchanges, the game pieces are removed from the board and the Draw Points are replenished.

In one embodiment, engagers also have the ability to use other trading cards which a participant may already have an interest in and/or a relationship with. The engagers may use the rules of the previously developed sports themed game during the exchanges in terms of which cards are used for which purposes and which player is the "victor". The engager also has the option of simplifying the rules of the sports insert engagement using Trading Card Game cards and/or using standard Sports Trading Cards (i.e. Baseball, Hockey, etc.). A specific piece of information such as the number associated with the power of the card; the number assigned to the strength of a given action (i.e. shot, pass, etc.); or other information printed on the trading cards (i.e. career goals, points, etc.) may be used to determine the winner. Using this method, the card played with the highest rating, number, etc. would be the "victor" of the exchange.

In one embodiment, engagers using trading cards are encouraged to discuss individual traits, experiences etc. that are relevant to the drawn Sports Situation Card as a part of the game interaction despite not having the formal Sports Character Attribute Ratings included on the stock Templay Sports Character Cards. An Engagement Spinner may be used as previously described and in accordance with the engager's assessment to enhance opportunities for experientials. The Winner may be determined by using the Templay winner spinner or previously designated as the player with the most Draw Point Markers, Designated Event Cards in their Victory Pile, etc.

Figure 21:
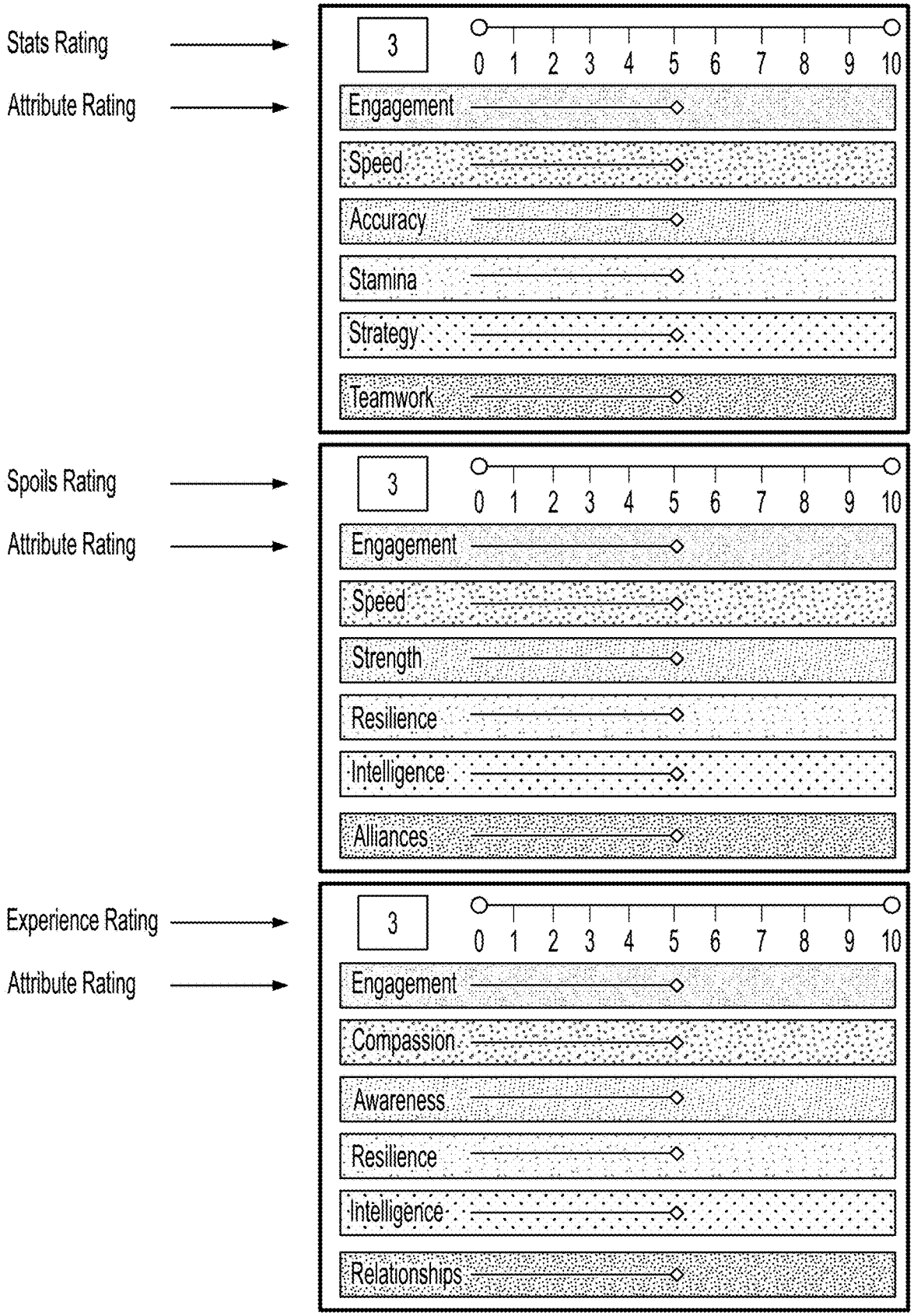
FIG. 21 depicts various embodiments of character cards potentially utilized in a Templay Engagement Process game play depending on the type of game played, being a sports card with stats ratings, a combat card with spoils ratings, and a storyline character card with experience ratings.
Figure 22:
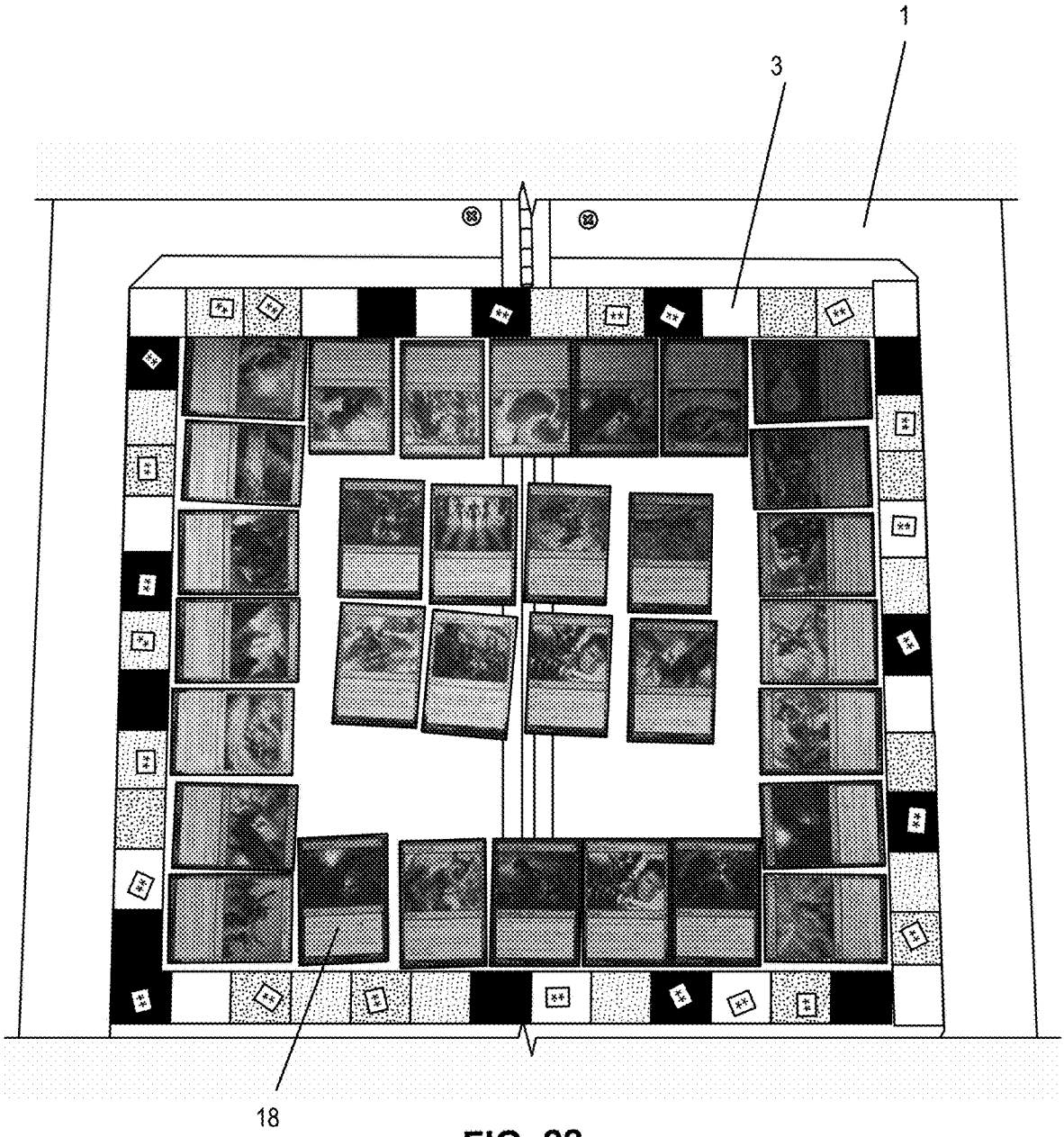
FIG. 22 depicts one embodiment of a Templay Engagement Process game set-up with a board structure utilizing traditional spaces and Magic the Gathering cards rather than playing cards as a potential prompt for game activities.
Figure 23:
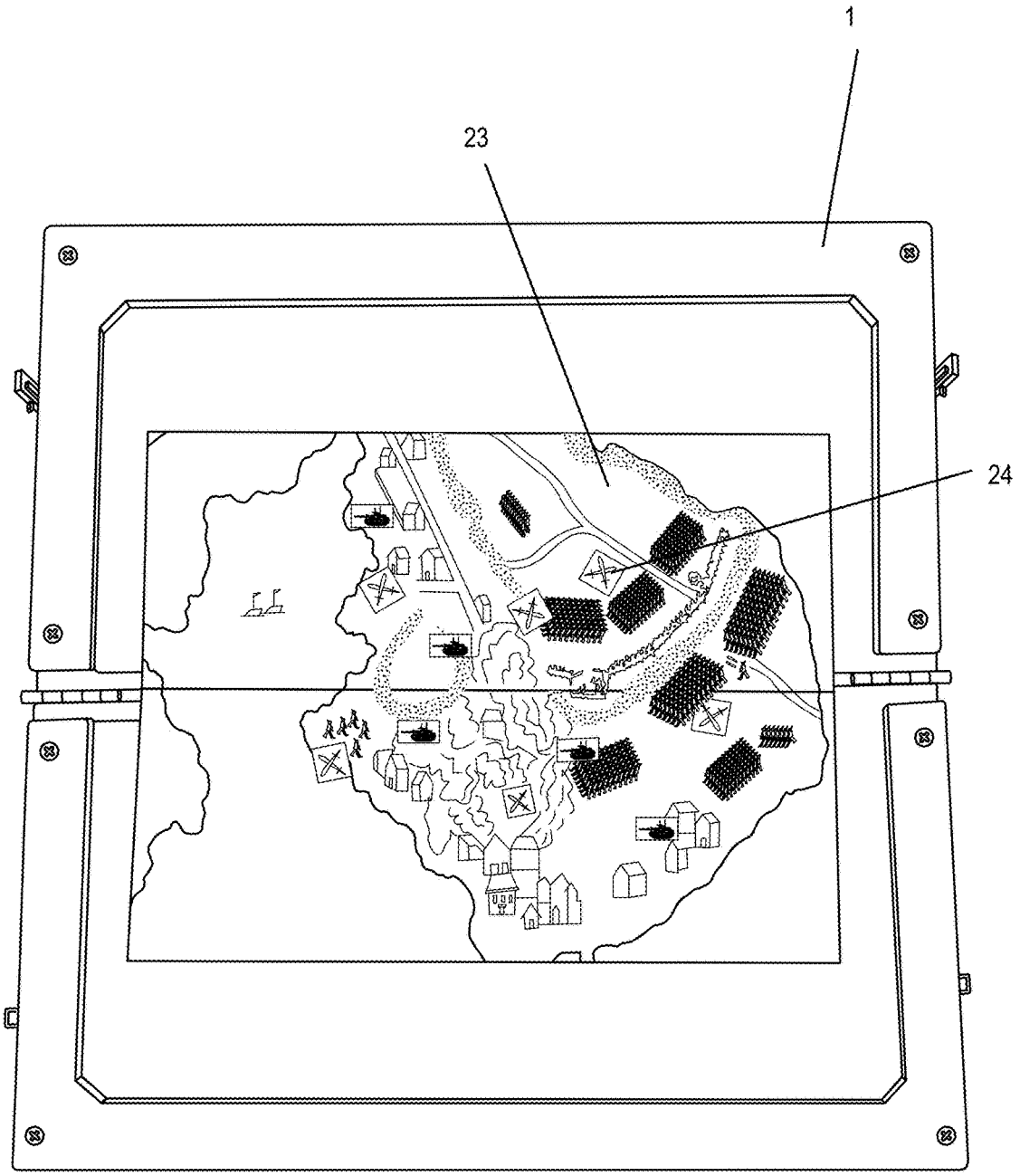
FIG. 23 depicts one embodiment of a Templay Engagement Process game set-up with a board structure integrating a war game with a revolutionary war theme. In this embodiment, again there are no traditional ladder type spaces, but there are draw points as described in the face-off structure descriptions for use with themed cards as the point of battle.

In one embodiment, Templay Face-off Combat Content Kits include themed Structure inserts (i.e. pirate ship, battlefield, gladiator arena, etc.). The "battle zone" is designed on the board. The Theme Inserts are arranged on the Board accordingly. Players take turns invading and being invaded. Ten Draw Points (24) are placed on the Board by the player on offense. See FIG. 23. The invading player advances their piece to the Draw Point closest to their side of the board. A Face Off is initiated by drawing a Designated Event Card. Each Face off is completed as described below. The player with the highest Attribute Rating for the relevant Attribute is the "victor". The winner of the exchange places the Designated Event Card in their Victory Pile and is awarded the Draw Point. When the player being invaded wins five exchanges, it is their turn to invade. The Draw Points are cleared from the board and redistributed by the new offensive player. When using Templay Universal and/or stock Templay Combat Cards, players will discuss which Attribute (i.e. Strength, Speed, etc.) would be most relevant to the drawn Situation Card. After the determination is made which Attribute will be the measure in the sports scenario, each player will select one of the cards from their bank to play against the other player(s). The player whose card has the highest measure for that Attribute Rating will be the winner of the exchange. See FIG. 21. The winner of the exchange places the Designated Event Card in their Victory Pile. An Attribute Reference Sheet is available for use during the engagement to facilitate Designated Event Engagements.

In one embodiment, engagers also have the ability to use other trading cards which a participant may already have an interest in. The engager's may use the rules of the previously developed game (i.e. Magic the Gathering®, Pokemon®, etc.) during the exchanges in terms of which cards are used for which purposes and which player is the "victor". The engager also has the option of simplifying the rules of the Storyline engagement using Trading Card Game cards. A specific piece of information such as the number associated with the "attack" power of the card; the number assigned to the strength of a given action (i.e. spell, enchantment, strike, etc.); or other information printed on the trading cards may be used to determine the winner. Using this method, the card played with the highest rating, number, etc. would be the "victor" of the exchange. Currency can be awarded using either the Traditional or Discretional Application as previously described. Engagers using trading cards are encouraged to discuss individual traits, experiences etc. which are relevant to the drawn Storyline Situation Card as a part of the game interaction despite not having the formal Character Attribute Ratings included on the stock Templay Character Cards. An Engagement Spinner may be used as previously described and in accordance with the Engager's assessment to enhance opportunities for experientials. The Winner may be determined by using a Templay winner spinner or previously designated as the player with the most tokens, cards, first player to reach the end of the Board Structure, etc. The engager's and/or individual's preference, context of the supportive situation and/or other considerations (i.e. length of time with individual, target experientials, etc.) may inform the Winner Designation.

In one embodiment, "Draw" Space inserts are Drawing Points which result in both players playing a card based upon a previously determined measure which can be adapted to the specific Trading Card Game they are building a deck for. Cards may be added to the Card Bank of the victor of each exchange or the victor may place their card in their Card Bank while the Loser would place their card in their Graveyard, depending on the players' discretions surrounding mixing their personal cards together. The Board Structure is collaboratively developed as previously described. The game is played in accordance to the rules developed by the engager and/or participant and/or as previously described. Structure Inserts and Space Content Inserts are placed and function as Draw Points to signify the selection of Designated Event Cards and/or to elicit Designated events as determined by the players during Game Development. Examples of Storyline Themes include but are not limited to Egyptian, Prehistoric, Outer Space, etc. Templay Engagement Process game structure also offers a platform for engagers to develop their own Templay Storyline Character Cards through a digital template. Storyline Structure Inserts are placed on the board at the individual's discretion. A Designated Event Card is picked each time a player either passes through and/or lands on a space which has a Storyline Structure Insert. Cards may be added to the Card Bank of the victor of each exchange or the victor may place their card in their Card Bank while the Loser would place their card in their Graveyard, depending on the players' discretions surrounding mixing their personal cards together. The game may also be adapted so that the cards associated with the spaces are facing down.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

What is claimed is:

1. A game system comprising:

a customizable, hinged, foldable blank board wherein, said board further comprises attachment mechanisms including at least, magnets and hook and loop fasteners, and wherein said customization includes at least:

an at least one individually sized space, wherein said at least one space is attachable and detachable to the board, comprising at least one playing space that is individually alignable and arrangeable in any non-preconfigured and non-preguided orientation or path and configured to attach and detach from said board before, during, and after game play, structure inserts, wherein said structure inserts are attachable and detachable housings configured to attach and detach from said board and further configured to receive inserts comprising images or other content wherein said inserts are configured to be aesthetic or act as procedural game prompts and configured to allow for the changing of inserts before, during, and after game play, space inserts, wherein said space inserts comprise either a housing configured to accept a printed image and is attachable and detachable to any space, or an image configured to be directly attachable or to any space wherein when said space insert is utilized with any space, it is configured to be aesthetic or act as a procedural game prompt, an at least one customizable spinner wherein said spinner comprises four quadrants configured as a housing to accept individual pre-printed images, content cards wherein said content cards comprise subject matter that act as game prompts;

content markers, wherein said content markers comprise game components to house specific pre-chosen game concept constructs comprising an emotion to be described, an action to be taken, or a term to be discussed and are configured to allow for interchangeable components and writeable and erasable surfaces configured to allow for adaptability and development before, during, and after game play, marking inserts, wherein said marking inserts comprise a housing area configured to accept, interchangeably, customizable question cards and a response area configured to allow a writeable and erasable answer to said question card, wherein play is always prefaced by and predicated upon a first and a second player engaging in a preliminary engagement process to determine the desired game structure and game elements according to the foregoing and developing a set of game rules in connection with each of the chosen said spaces, structure inserts, space inserts, spinner, content cards, content markers, and marking inserts and wherein said engagement process may comprise ongoing in-game game board modifications.

2. The game system of claim 1 further comprising reflection cards, wherein said reflection cards comprise expressive images and specific characters configured as an engagement prompt.

3. The game system of claim 1 wherein the structure inserts are configured to be face-off inserts wherein said face-off inserts substantially alter game play by superseding said at least one playing space and space inserts within the game board.

4. The game system of claim 1 further comprising game components chosen from the group of:

game pieces, game currency, game decisional means, and gaming cards.

5. The game system of claim 1 further comprising game components chosen from the group of:

sports trading cards, pre-existing gaming cards, artwork, pictures, outside activity games, at least one of a specific spinner types, face-off structure inserts, and storylines.

* * * * *